US008226583B2

(12) United States Patent
Ikeler et al.

(10) Patent No.: US 8,226,583 B2
(45) Date of Patent: Jul. 24, 2012

(54) EFFICIENT HIGH FREQUENCY CHEST WALL OSCILLATION SYSTEM

(75) Inventors: Timothy J. Ikeler, Mount Pleasant, SC (US); Mayur Yermaneni, Shrewsbury, MA (US); Robert Petrosenko, Charleston, SC (US); Matthew J. Sampson, Cincinnati, OH (US); Dennis G. O'Keefe, Cincinnati, OH (US); Ross M. Leon, Cincinnati, OH (US); Eric Larson, Spring Valley, OH (US)

(73) Assignee: Hill-Rom Services, Pte. Ltd., Singapore (SG)

( * ) Notice: Subject to any disclaimer, the term of this patent is extended or adjusted under 35 U.S.C. 154(b) by 1118 days.

(21) Appl. No.: 11/924,110

(22) Filed: Oct. 25, 2007

(65) Prior Publication Data

US 2009/0221941 A1 Sep. 3, 2009

Related U.S. Application Data

(60) Provisional application No. 60/869,766, filed on Dec. 13, 2006.

(51) Int. Cl.
*A61H 31/00* (2006.01)
*F04B 17/00* (2006.01)

(52) U.S. Cl. ..... 601/44; 601/41; 601/43; 601/84; 601/148; 601/152; 417/206; 417/413; 417/488

(58) Field of Classification Search ..... 601/41, 601/43, 44, 76–79, 89, 93, 148–152; 417/206, 417/413, 488

See application file for complete search history.

(56) References Cited

U.S. PATENT DOCUMENTS

| | | | | |
|---|---|---|---|---|
| 2,478,568 | A * | 8/1949 | Coe | 417/385 |
| 2,762,366 | A | 9/1956 | Huxley, III et al. | |
| 2,772,673 | A | 12/1956 | Huxley, III | |
| 2,779,329 | A | 1/1957 | Huxley, III et al. | |
| 2,780,222 | A | 2/1957 | Polzin et al. | |
| 2,832,335 | A | 4/1958 | Huxley, III et al. | |
| 3,120,228 | A | 2/1964 | Huxley, III | |
| 3,179,106 | A | 4/1965 | Meredith | |
| 3,252,498 | A * | 5/1966 | Ball | 137/99 |
| 3,333,581 | A | 8/1967 | Robinson et al. | |
| 3,566,862 | A | 3/1971 | Schuh et al. | |
| 3,896,794 | A | 7/1975 | McGarth | |
| 4,003,373 | A | 1/1977 | Spelio | |

(Continued)

FOREIGN PATENT DOCUMENTS

CA 2 449 093 A1 5/2004

(Continued)

OTHER PUBLICATIONS

European search report from EP 07 25 4727 dated Apr. 23, 2009.

(Continued)

*Primary Examiner* — Justine Yu
*Assistant Examiner* — LaToya M. Louis
(74) *Attorney, Agent, or Firm* — Barnes & Thornburg LLP

(57) ABSTRACT

A HFCWO system includes an air pulse generator having a blower inlet in communication with a blower and an air port in communication with an inflatable garment. The air pulse generator includes a housing and an air pulse assembly coupled to the housing. The air pulse assembly has at least one diaphragm, at least one driver operable to move the at least one diaphragm and at least one spring arranged to bias the at least one diaphragm away from a portion of the housing.

14 Claims, 17 Drawing Sheets

U.S. PATENT DOCUMENTS 4,079,733 A 3/1978 Denton et al.
4,398,531 A 8/1983 Havstad
4,424,806 A 1/1984 Newman et al.
4,637,386 A 1/1987 Baum
4,805,612 A 2/1989 Jensen
4,838,263 A 6/1989 Warwick et al.
4,867,654 A * 9/1989 Zebuhr ..... 417/393
4,971,042 A 11/1990 Lerman
4,977,889 A 12/1990 Budd
5,056,505 A 10/1991 Warwick et al.
5,092,326 A 3/1992 Winn et al.
5,105,790 A * 4/1992 Nye, Jr. ..... 123/527
5,159,924 A * 11/1992 Cegielski et al. ..... 128/203.12
5,169,291 A * 12/1992 Zebuhr ..... 417/41
5,257,639 A * 11/1993 Prescott et al. ..... 137/82
5,385,141 A * 1/1995 Granatiero ..... 128/201.19
5,405,251 A * 4/1995 Sipin ..... 417/420
5,453,081 A 9/1995 Hansen
5,508,908 A 4/1996 Kazama et al.
5,569,170 A 10/1996 Hansen
5,720,415 A * 2/1998 Morningstar ..... 222/1
5,769,797 A 6/1998 Van Brunt et al.
5,830,164 A 11/1998 Cone et al.
5,836,751 A * 11/1998 De Villiers ..... 417/413.1
5,997,488 A 12/1999 Gelfand et al.
6,030,353 A 2/2000 Van Brunt
6,036,662 A 3/2000 Van Brunt et al.
6,066,101 A 5/2000 Johnson et al.
6,079,960 A * 6/2000 Funatsu et al. ..... 417/488
6,179,793 B1 1/2001 Rothman et al.
6,210,345 B1 4/2001 Van Brunt
6,254,556 B1 7/2001 Hansen et al.
6,340,025 B1 1/2002 Van Brunt
D453,560 S 2/2002 Van Brunt
6,379,316 B1 4/2002 Van Brunt et al.
6,415,791 B1 7/2002 Van Brunt
6,468,237 B1 10/2002 Lina
6,488,641 B2 12/2002 Hansen
6,544,202 B2 4/2003 McEwan et al.
6,675,799 B2 * 1/2004 Fuhrman et al. ..... 128/205.15
7,115,104 B2 10/2006 Van Brunt et al.
2002/0057974 A1 * 5/2002 Toyama et al. ..... 417/417
2003/0192324 A1 * 10/2003 Smith et al. ..... 62/6
2004/0136560 A1 * 7/2004 Walsh ..... 381/401
2005/0235988 A1 10/2005 Hansen et al.
2007/0129653 A1 * 6/2007 Sugar et al. ..... 601/5

FOREIGN PATENT DOCUMENTS

JP 2001-238288 8/2001
SE 143165 12/1953
WO WO 02/06673 A1 1/2002

OTHER PUBLICATIONS

Partial European Search Report from EP 07 25 427.6 (7 pages), dated Jan. 26, 2009.

* cited by examiner

EFFICIENT HIGH FREQUENCY CHEST WALL OSCILLATION SYSTEM

CROSS REFERENCE TO RELATED APPLICATION

This application claims the benefit of U.S. Provisional Patent Application Ser. No. 60/869,766, filed on Dec. 13, 2006, which is hereby incorporated by reference herein.

BACKGROUND OF THE INVENTION

The present disclosure relates generally to high frequency chest wall oscillation (HFCWO) systems, and more particularly, to HFCWO systems for use with an inflatable garment.

Manual percussion techniques of chest physiotherapy have been used for a variety of diseases, such as cystic fibrosis, emphysema, asthma and chronic bronchitis, to remove excess mucus that collects in the lungs. To bypass dependency on a caregiver to provide this therapy, chest wall oscillation devices have been developed to deliver HFCWO therapy to a patient. An illustrative HFCWO system is disclosed in U.S. Pat. No. 7,115,104 ("the '104 patent"), which is hereby incorporated by reference herein. In the system disclosed in the '104 patent, an air pulse generator produces high frequency air pulses which are applied to an inflatable garment positioned about a patient's torso. The term "air" as used in the specification and claims is used broadly to include regular air, medical air, nitrogen, oxygen, and any other breathable, as well as non-breathable, gas available in a hospital or healthcare facility.

SUMMARY OF THE INVENTION

The present invention comprises an apparatus or a system that has one or more of the following features or combinations thereof, which alone or in any combination may comprise patentable subject matter:

A HFCWO system may comprise an air pulse generator and a blower. The air pulse generator may comprise a housing and an air pulse assembly coupled to the housing. The air pulse assembly may include at least one diaphragm, at least one driver operable to move the at least one diaphragm, and at least one spring interposed between the at least one diaphragm and a portion of the housing. The housing may have a blower inlet in communication with the blower and an air port in communication with an inflatable garment.

The housing may include at least one wall. The at least one spring may be positioned in a state of compression between the at least one diaphragm and the at least one wall. The at least one driver may comprise a current-carrying coil coupled to one of the at least one diaphragm and the at least one wall and a permanent magnet coupled to the other of the at least one diaphragm and the at least one wall. The current-carrying coil may include a pair of leads through which an oscillating current may be applied to the current-carrying coil. The magnet may have a ring-shaped body defining an interior space and the current-carrying coil may be located in the interior space of the ring-shaped body. The at least one spring may comprise a coil spring having a large diameter bore and the ring-shaped body may be located in the large diameter bore.

In some embodiments, the at least one driver may comprise an oscillating current-carrying coil coupled to one of the at least one diaphragm and the at least one wall and a DC current-carrying coil coupled to the other of the at least one diaphragm and the at least one wall. In some embodiments, the oscillating current-carrying coil may have a pair of leads through which an oscillating current may be applied to the oscillating current-carrying coil. The DC current-carrying coil may have a pair of leads through which a DC current may be applied to the DC current-carrying coil. The DC current-carrying coil may have a first ring-shaped body defining an interior space and the oscillating current-carrying coil may be located in the interior space of the first ring-shaped body. The oscillating current-carrying coil may have a second ring-shaped body defining an interior space and the at least one spring may be located in the interior space of the second ring-shaped body.

In some embodiments, the at least one wall may comprise first and second walls. The at least one diaphragm may comprise first and second diaphragms. The at least one driver may comprise first and second drivers. The at least one spring may comprise first and second springs. The first diaphragm may be located near the first wall. The first driver may be operable to move the first diaphragm. The first spring may be arranged to bias the first diaphragm away from the first wall. The second diaphragm may be located near the second wall. The second driver may be operable to move the second diaphragm. The second spring may be arranged to bias the second diaphragm away from the second wall.

The first driver may comprise a first oscillating current-carrying coil coupled to the first diaphragm and a first DC current-carrying coil coupled to the first wall. The second driver may comprise a second oscillating current-carrying coil coupled to the second diaphragm and a second DC current-carrying coil coupled to the second wall. The housing may include an air port in communication with an air chamber located between the first and second diaphragms. The housing may include a blower inlet spaced from the air port and in communication with the air chamber.

In some embodiments, the HFCWO system may include an inflatable garment arranged to be positioned about a patient's torso and a blower arranged to supply air under pressure. The air port may be connectible to the inflatable garment and the blower inlet may be connectible to the blower. A check valve may be coupled to the blower inlet. A portion of the air from the blower may be diverted to cool the DC current-carrying coil. The air pulse generator may include first and second bumpers coupled to the housing to protect the first and second oscillating current-carrying coils from accidental contact with the housing.

The first and second diaphragms may each comprise a piston and a flexible seal coupled to the piston and coupled to the housing. The flexible seals may extend between the outer periphery of the pistons and the inner periphery the housing. The flexible seals may be annular. The flexible seals may extend across outer surfaces of the pistons.

In some embodiments, the driver may comprise at least one cam operable to move the at least one diaphragm and a motor coupled to the at least one cam for rotating the at least one cam. The at least one diaphragm may comprise a first pair of opposed diaphragms and a second pair of opposed diaphragms. The at least one cam may comprise first and second generally elliptical cams mounted on a shaft for rotation therewith. The first cam may be operable to move the first pair of opposed diaphragms toward and away from each other along a first axis. The second cam may be operable to move the second pair of opposed diaphragms toward and away from each other along a second axis that may be substantially perpendicular to the first axis. The first and second cams may be mounted on the shaft such that, when the first pair of diaphragms move toward each other, the second pair of diaphragms move toward each other, and such that, when the first pair of diaphragms move away from each other, the second pair of diaphragms move away from each other.

In some embodiments, an air pulse generator may comprise a blower, and a valve that is coupled to the blower and coupled to the inflatable garment and that is movable to apply oscillating pressure to the inflatable garment. In some embodiments, the valve may be a rotary valve. In other embodiments, the valve may be a flapper valve. The blower may include an inlet port and an outlet port. The rotary valve may include a housing and a rotor rotatably coupled to the housing. The housing may include a first port in communication with the blower outlet port, a second port in communication with the inflatable garment, a third port in communication with the blower inlet port, and a fourth port in communication with the atmosphere. The rotor may include first and second passageways such that, in one position of the rotor relative to the housing, one of the two passageways may couple the first port to the second port to couple the blower outlet port to the inflatable garment and the other of the two passageways may couple the third port to the fourth port to couple the blower inlet port to the atmosphere, and such that, in another position of the rotor relative to the housing, one of the two passageways may couple the first port to the fourth port to couple the blower outlet port to the atmosphere and the other of the two passageways may couple the second port to the third port to couple the inflatable garment to the blower inlet. In some embodiments, the valve may be a solenoid valve. A bypass line may couple the blower outlet port to the inflatable garment to provide a positive baseline or offset pressure. A control valve may be coupled to the bypass line.

In some embodiments, an air pulse generator may comprise a plurality of pistons coupled to a piston rod for movement therewith and a cylinder having a plurality of air chambers for receiving the associated pistons. Each chamber may have an inlet port couplable to a blower and an outlet port couplable to an inflatable garment. The air pulse generator may further comprise a driver coupled to the piston rod and operable to alternatively force air into the inflatable garment and draw air from the inflatable garment. In some embodiments, the air pulse generator may further comprise a plurality of check valves coupled to the respective inlet ports.

Additional features, which alone or in combination with any other feature(s), such as those listed above and those listed in the appended claims, may comprise patentable subject matter and will become apparent to those skilled in the art upon consideration of the following detailed description of illustrative embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Figure 1:
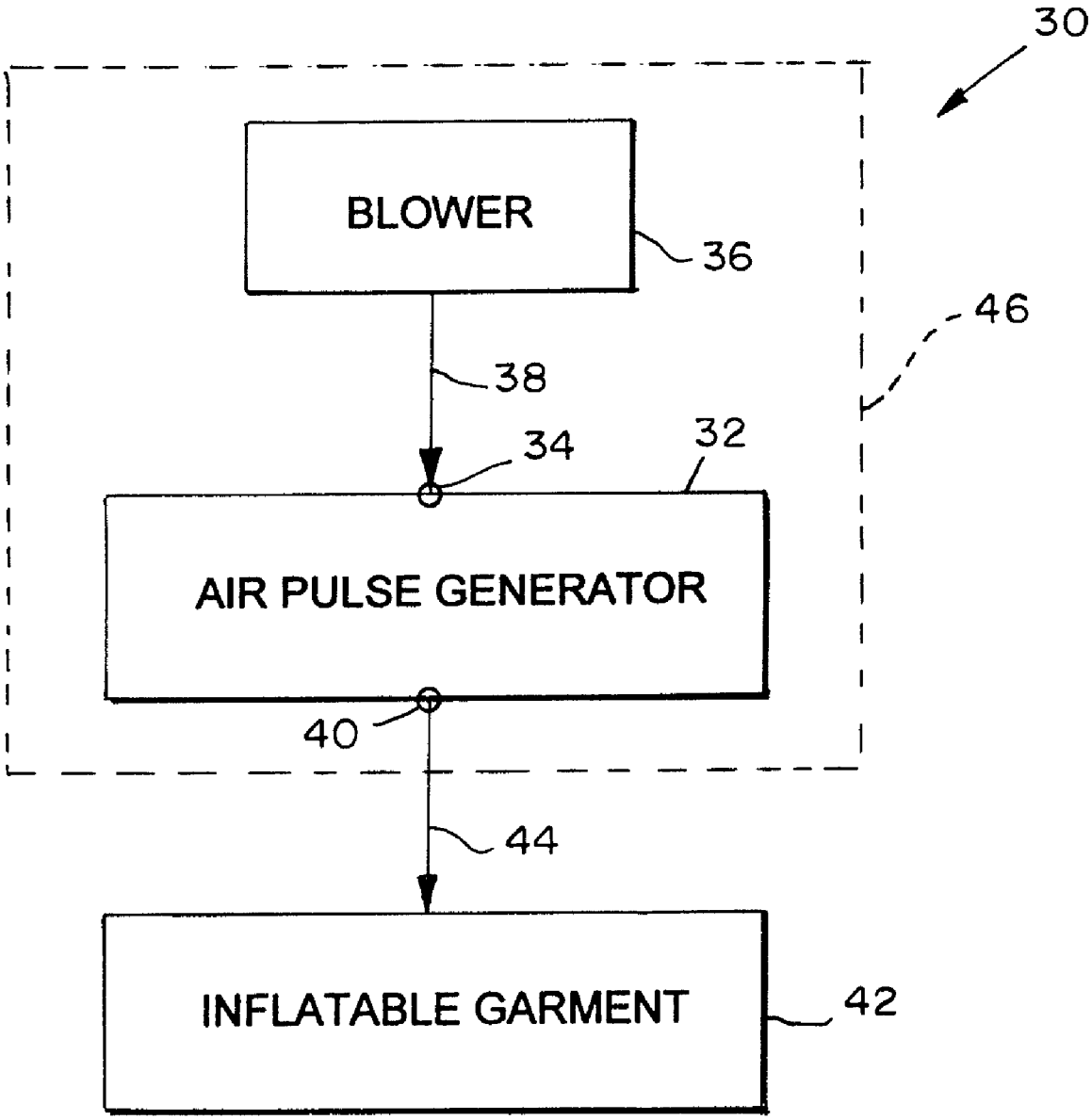
FIG. 1 is a block diagram of an illustrative HFCWO system showing an air pulse generator having a blower inlet in communication with a blower and an air port in communication with an inflatable garment.
Figure 2:
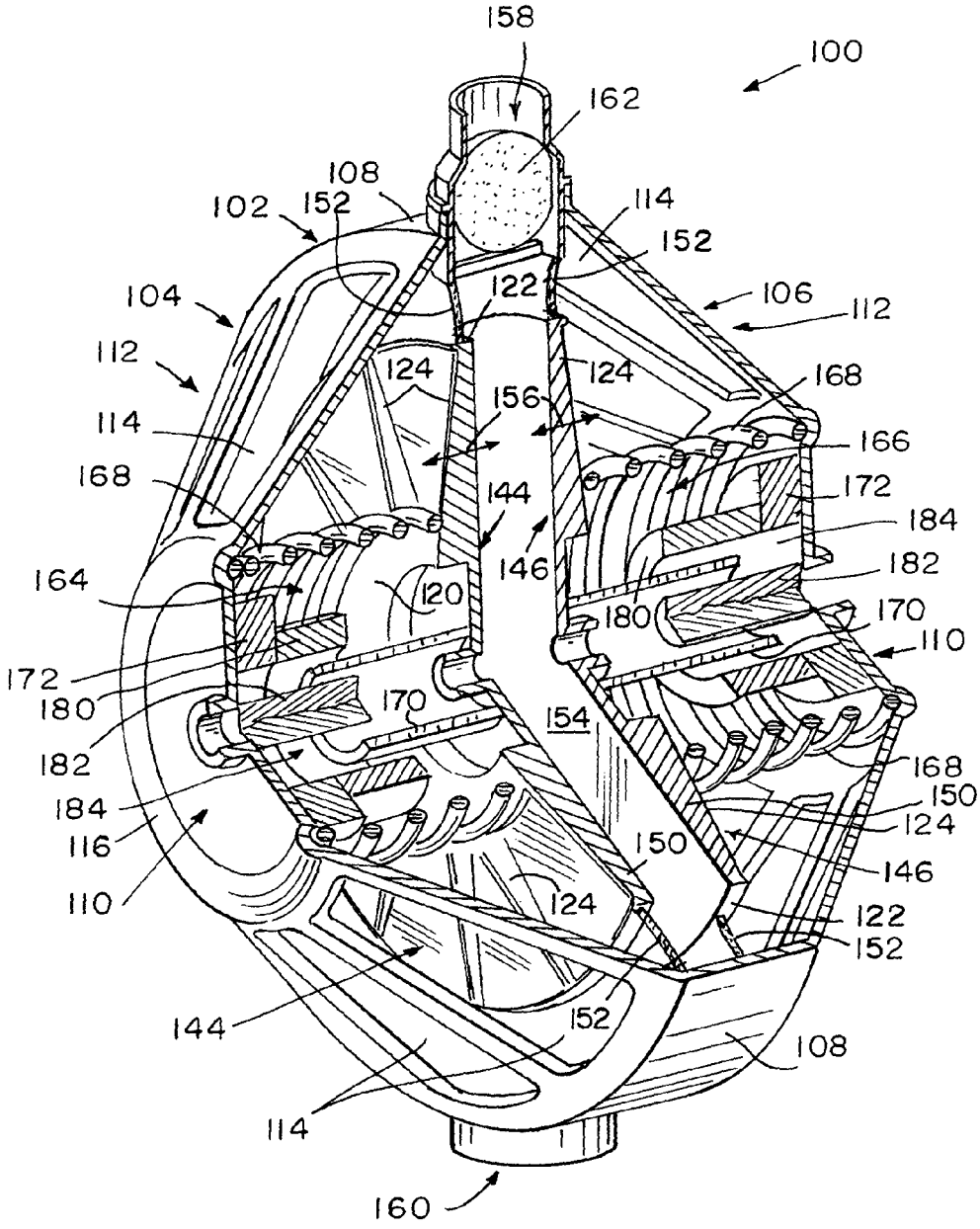
FIG. 2 is a perspective view, with portions broken away, of a first embodiment of the air pulse generator of FIG. 1 showing a housing having first and second dome-shaped side walls and an annular rim extending between the side walls, first and second generally disc-shaped diaphragms located near the first and second side walls, the first and second diaphragms and the annular rim defining an air chamber having an air port and a blower inlet, first and second drivers operable to move the first and second diaphragms, first and second springs interposed between the first and second diaphragms and the first and second side walls, each driver comprising a current-carrying coil coupled to an associated diaphragm and a ring-shaped permanent magnet supported by an associated side wall.
Figure 4:
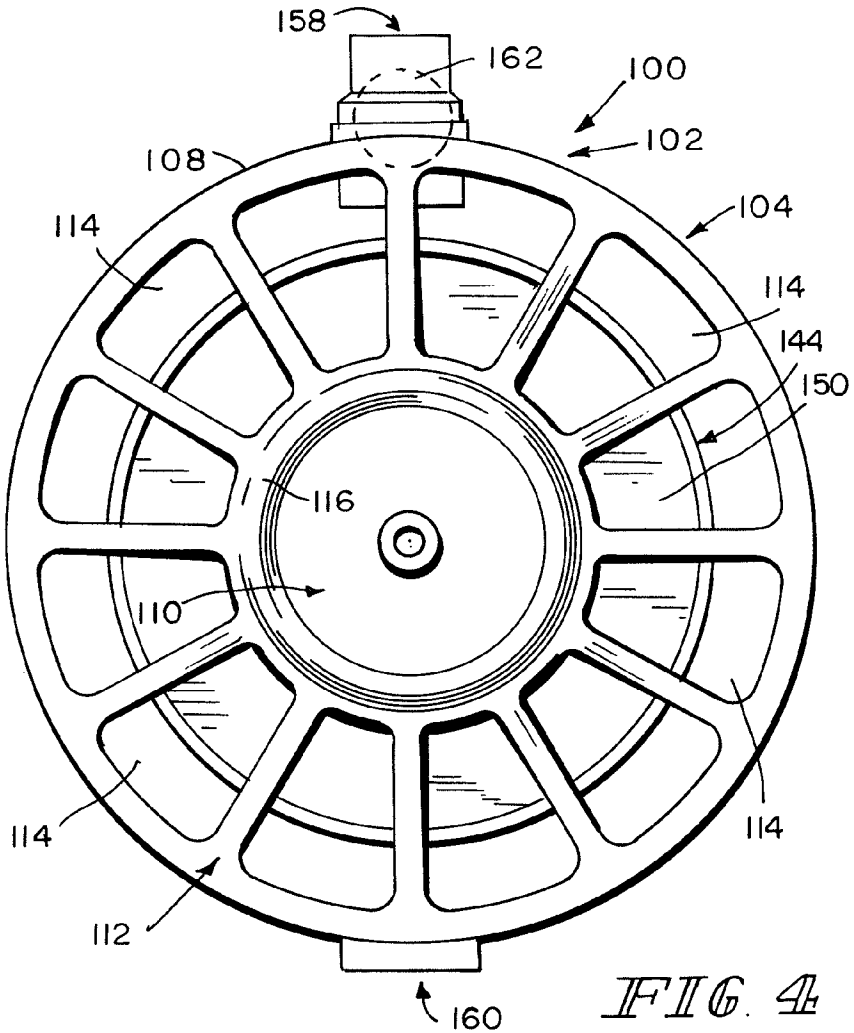
FIG. 4 is a side elevation view of the air pulse generator of FIG. 2.
Figure 3:
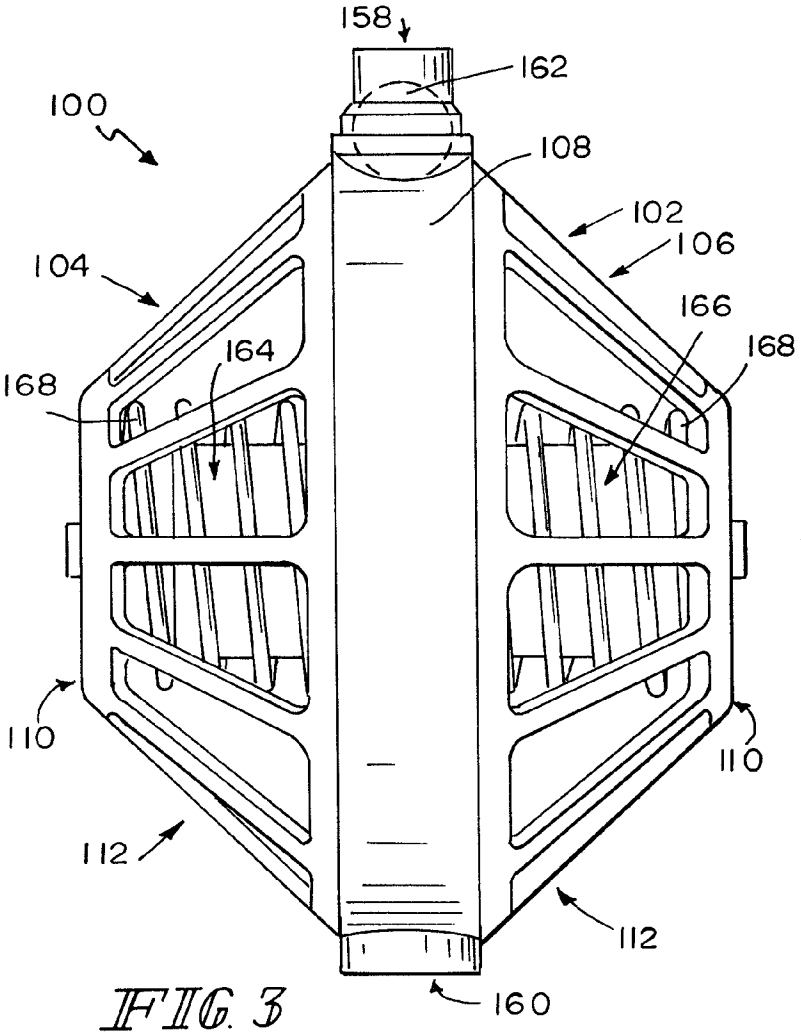
FIG. 3 is a front elevation view of the air pulse generator of FIG. 2.

FIG. 1 diagrammatically shows an illustrative HFCWO system 30. The HFCWO system comprises an air pulse generator 32 having at least one blower inlet 34 connectible to a blower 36 via a line 38 and at least one air port 40 connectible to an inflatable garment 42 via a line 44. The inflatable garment 42 is configured to be positioned over a patient's torso to apply HFCWO therapy to the patient. The air pulse generator 32 and the blower 36 may be located in a housing 46 shown in phantom in FIG. 1. FIGS. 2-5 show a first embodiment 100 of the air pulse generator 32. As shown in FIGS. 2-5, the air pulse generator 100 includes a generally tubular housing or shell 102 comprising oppositely-disposed first and second dome-shaped side walls 104, 106 and an annular rim 108 extending between the first and second side walls 104, 106. The dome-shaped side walls 104, 106 are removably secured to the annular rim 108 by suitable fasteners, such as screws. In the illustrated embodiment, each side wall 104, 106 includes a generally round and flat first portion 110 and a generally frustoconical second portion 112 that flares outwardly from a relatively small diameter to a relatively large diameter in a direction from where the frustoconical portion 112 attaches to the flat portion 110 to where the frustoconical portion 112 attaches to the annular rim 108. As shown in FIG. 2, the frustoconical portions 112 have a plurality of relatively large openings 114 which not only reduce the weight of the housing 102, but also allow air to circulate therethrough to cool a pair of diaphragms 144, 146 and the drivers (discussed below) that oscillate the diaphragms 144, 146 relative to the housing 46. The outwardly-facing surface of each flat portion 110 has a reinforcing bead 116 around its perimeter.

Figure 5:
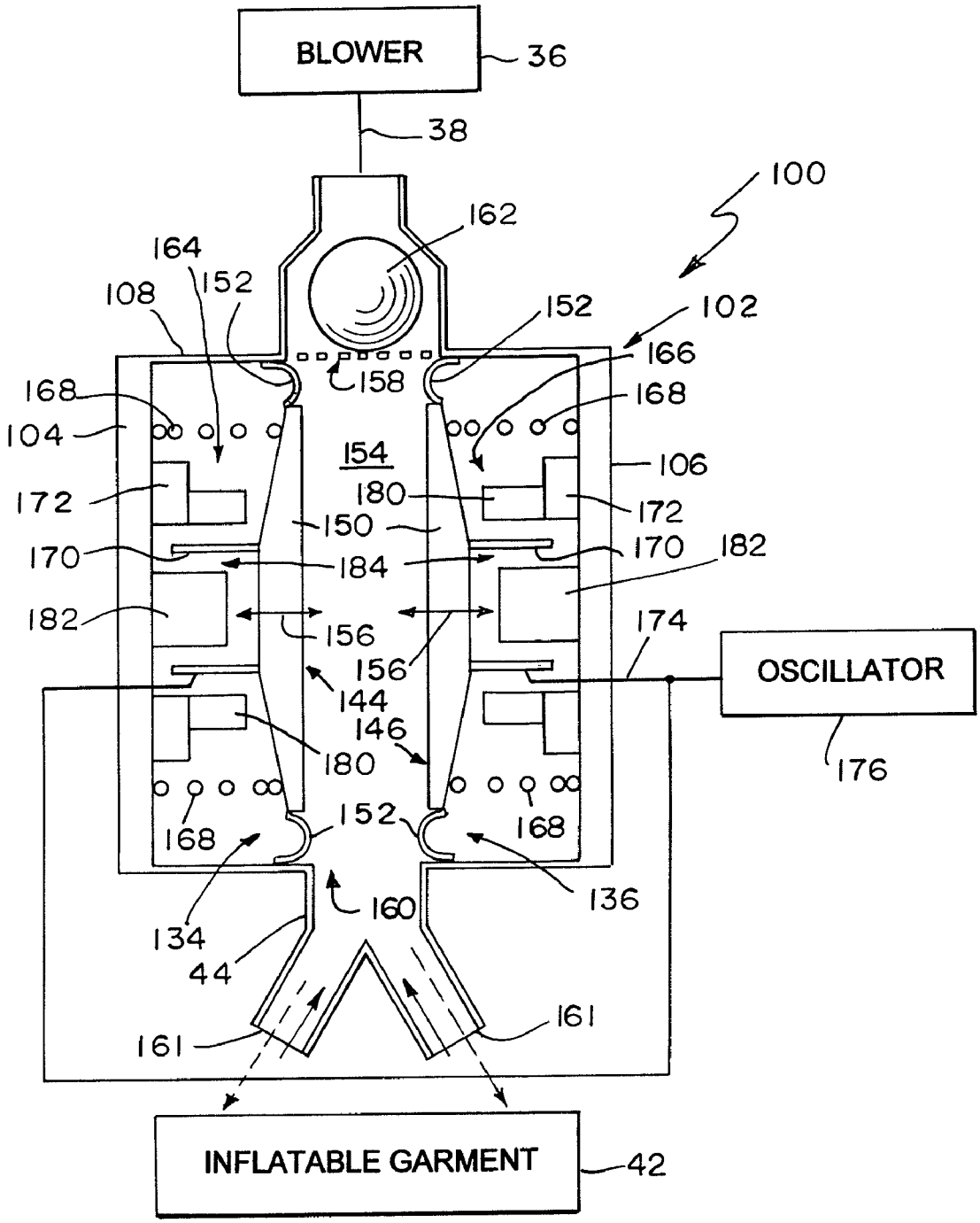
FIG. 5 is a diagrammatic view of the first embodiment of the air pulse generator of FIG. 2.

As shown diagrammatically in FIG. 5, the annular rim 108 defines first and second diaphragm openings 134, 136. A first diaphragm 144 is positioned across the first diaphragm opening 134. A second diaphragm 146 is positioned across the second diaphragm opening 136. Each diaphragm 144, 146 includes a relatively rigid generally circular diaphragm plate or piston 150 and an annular relatively flexible diaphragm seal 152 interposed between an outer periphery of the piston 150 and an inner periphery of the annular rim 108. The two opposed diaphragms 144, 146 and the annular rim 108 of the housing 102 define an air chamber 154. Each diaphragm seal 152 forms a substantially fluid-tight seal between the diaphragm plate 150 and the inner periphery of the annular rim 108.

As shown in FIG. 2, in the illustrated embodiment, a generally circular central hub 120 extends rearwardly from each diaphragm plate 150 and an annular rim 122 extends rearwardly from a perimeter edge of each diaphragm plate 150. A plurality of rearwardly-projecting ribs 124 extend radially outwardly at substantially equally angularly spaced intervals from the central hub 120 to the annular rim 122. Illustratively, each diaphragm seal 152 has a generally u-shaped cross section. The diaphragm seals 152 not only support the diaphragm plates 150 relative to the housing 102, but also are sufficiently flexible to allow the diaphragm plates 150 to be laterally moved relative to the air chamber 154, as shown in FIG. 2 by double headed arrows 156, to pulse the air in the chamber 154. In addition, the diaphragm seals 152 urge the diaphragm plates 150 to return to their respective neutral positions after moving. The diaphragm plates 150 are sometimes referred to as piston plates or simply as pistons. The diaphragm seals 152 are sometimes referred to as suspensions, surrounds, or spiders.

The annular rim 108 of the housing 102 has a blower inlet 158 in communication with the air chamber 154 and an air port 160 in communication with the air chamber 154. In the illustrated embodiment, the blower inlet 158 and the air port 160 are positioned 180° apart on the opposite sides of the rim 108, although this need not be the case. As shown diagrammatically in FIG. 5, the blower inlet 158 is connectible to the blower 36 via a line 38 and the air port 160 is connectible to the inflatable garment 42 via a line 44. A floating ball check valve 162 is coupled to the blower inlet 158, although other types of check valves will suffice and in some embodiments, no check valve is present at all. The check valve 162 allows pressurized air from the blower 36 to flow to the air chamber 154 to establish a baseline pressure therein and in the inflatable garment 42. However, the check valve 162 automatically closes when the pressurized air from the air chamber 154 attempts to flow back toward the blower 36 in the reverse direction, for example, when the pressure in the air chamber 154 increases in response to the diaphragms 144, 146 moving toward each other. In the illustrated embodiment, the air port 160 is bifurcated into a pair of spaced-apart ports 161 (shown diagrammatically in FIG. 5). Each of the spaced-apart ports 161 is coupled to an air opening in the inflatable garment 42 via a hose (not shown). In the illustrated embodiment, the housing 102 and the diaphragm plates 150 are made from ABS (Acrylonitrile Butadiene Styrene) plastic, although any material, such as other plastic materials and/or metal materials, that have sufficient strength and durability may be used.

As shown diagrammatically in FIG. 5, the air pulse generator 100 includes first and second drivers 164, 166 coupled to the first and second diaphragms 144, 146. The drivers 164, 166 are operable to move the diaphragms 144, 146 in an oscillatory manner and in opposite directions relative to the housing 102. This causes the pressurized air in the chamber 154 to pulse by repetitively increasing and decreasing the air pressure about the baseline pressure. The air pulse generator 100 includes coil springs 168 for biasing the diaphragm plates 150 away from the associated walls 104, 106. The coil springs 168 are in a state of compression between the diaphragm plates 150 and the associated walls 104, 106. Ribs 116 of walls 104, 106 each provide an annular trough in which one end of respective springs 168 is received and ribs 124 of diaphragms 144, 146 each have a groove in which a portion of an opposite end of respective springs 168 is received. Receipt of the ends of springs 168 in the troughs formed by ribs 116 and the grooves formed in ribs 124 helps to retain springs 168 in place.

As shown diagrammatically in FIG. 5, each driver 164, 166 comprises an oscillating current-carrying coil 170 coupled to an associated diaphragm plate 150 and a permanent magnet 172 coupled to an associated side wall 104, 106. Each current-carrying coil 170 has a pair of leads 174 connected to an oscillator 176, which causes an oscillating current to flow through the associated coil 170. Each coil 170 extends outwardly from an associated diaphragm plate 150. Each permanent magnet 172 extends inwardly from an associated side wall 104, 106. Each magnet 172 has a ring-shaped body defining an interior region and the coil 170 is located in the interior region defined by the ring-shaped body. Each coil spring 168 has a large diameter bore and the ring-shaped body of the magnet 172 is located in the large diameter bore.

The current-carrying coil 170 is sometimes referred to as a voice coil. The current-carrying coil 170 comprises a coil of fine insulated wire wrapped about a spool of non-magnetic material, such as Kapton. The drivers 164, 166 are also referred to as linear motors, voice coil actuators, and speaker drivers. In one embodiment, the drivers 164, 166 are BEI Kimco Magnetics voice coil actuators, Model No. LA24-20-000A. These motors produce a peak force of about 25 lbs. and a continuous stall force of about 10.1 lbs. Each motor weighs about 1.615 lbs. (i.e., about 3.23 lbs. per set of two motors). The motors may be actively cooled with blower air.

Each driver 164, 166 includes a ring-shaped pole piece 180 that extends inwardly from the ring-shaped body of the magnet 172 and a cylindrical pole piece 182 that extends inwardly from the associated side wall 104, 106. An inwardly-facing surface of the ring-shaped pole piece 180 and an outwardly-facing surface of the cylindrical pole piece 182 define a relatively narrow cylindrical air gap 184. A substantially uniform magnetic field is concentrated in the cylindrical air gap 184. The current-carrying coil 170 is positioned substantially coaxially in the air gap 184 so that the ring-shaped pole piece 180 is located outside the coil 170 and the cylindrical pole piece 182 is located inside the coil 170. The coil 170 moves back and forth in the air gap 184 in response to the application of an oscillating current to the coil 170.

In some embodiments, the coil 170 remains in the air gap 184 throughout its back-and-forth movement. In some embodiments, the number of windings of the coil 170 within the air gap 184 remain relatively constant as the coil 170 moves back and forth. The large openings 114 in the side walls 104, 106 of the housing 102 not only reduce the weight of the air pulse generator 100, but also allow the air to flow therethrough to cool the diaphragms 144, 146, and the coils 170 attached thereto. Other technologies may very well be used for converting electrical signals into back-and-forth movement of the diaphragms 144, 146. These technologies include, for example, piezoelectric and electrostatic transducers.

Figure 6:
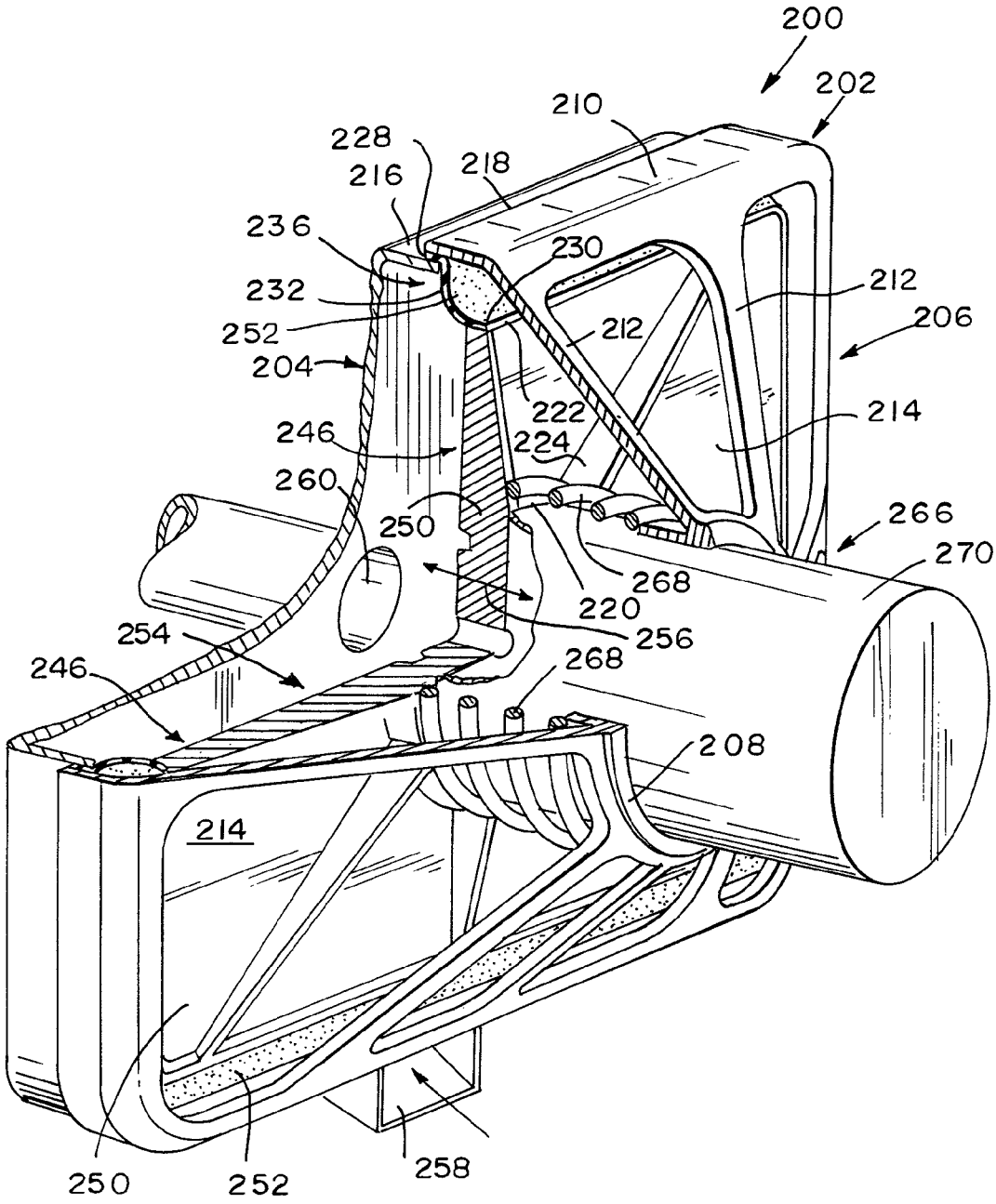
FIG. 6 is a perspective view, with portions broken away, of a second embodiment of the air pulse generator of FIG. 1 showing a housing having a generally rectangular flat side wall on one side and a generally rectangular dome-shaped side wall on an opposite side, a single generally rectangular diaphragm located near the dome-shaped side wall of the housing, the generally rectangular flat side wall and the generally rectangular diaphragm defining an air chamber having an air port and a blower inlet, a driver operable to move the diaphragm, the driver comprising a current-carrying coil coupled to the diaphragm and a ring-shaped permanent magnet supported by the dome-shaped side wall, and a spring interposed between the diaphragm and the dome-shaped side wall.
Figure 8:
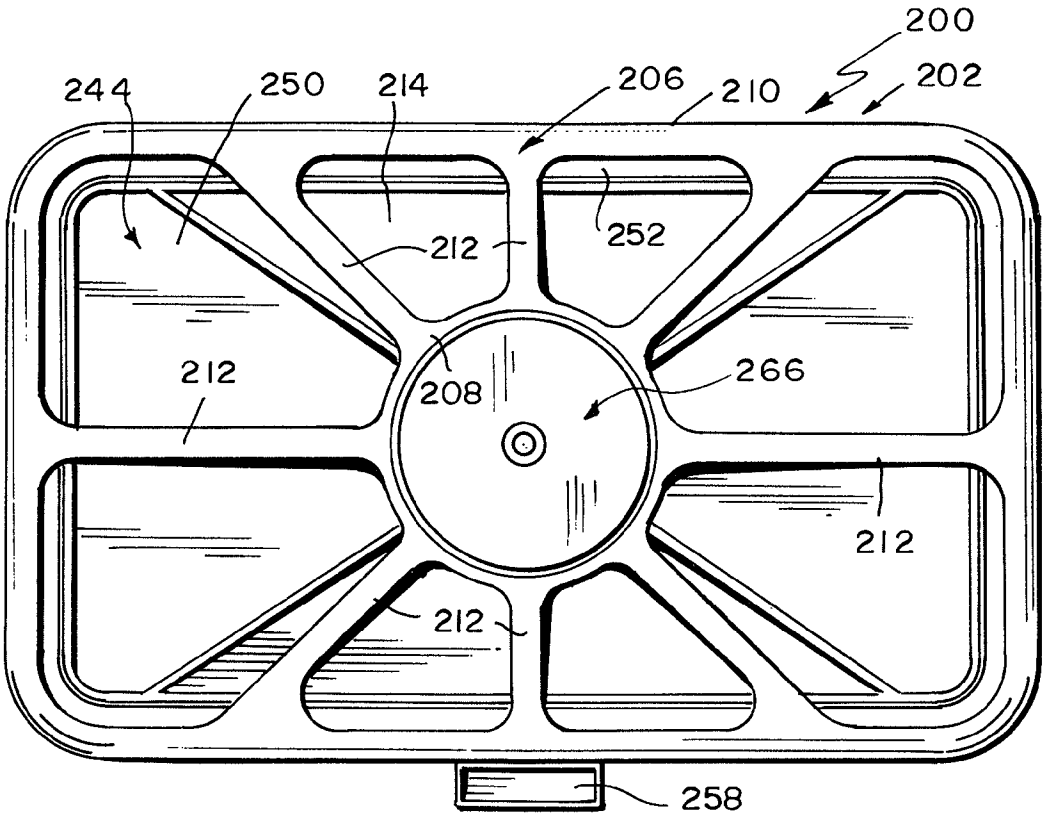
FIG. 8 is a side elevation view of the air pulse generator of FIG. 6.
Figure 7:
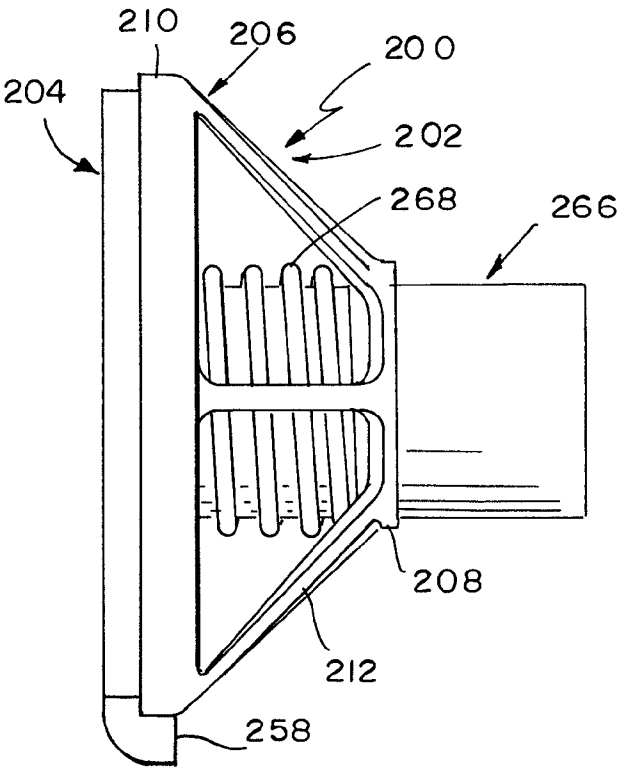
FIG. 7 is a front elevation view of the air pulse generator of FIG. 6.

FIGS. 6-8 show a second embodiment 200 of the air pulse generator 32. The air pulse generator 200 of FIGS. 6-8 is generally similar to the air pulse generator 100 of FIGS. 1-5, except that the air pulse generator 200 uses a single generally rectangular diaphragm 246 driven by a single driver 266 instead of two generally circular diaphragms 144, 146 driven by associated drivers 164, 166. As shown in FIGS. 6-8, the air pulse generator 200 includes a generally box-shaped housing or shell 202 comprising a generally rectangular flat side wall 204 on one side and a generally rectangular dome-shaped side wall 206 on an opposite side. The dome-shaped side wall 206 includes a generally circular central hub 208 at one end, a generally rectangular annular rim 210 at an opposite end, and a plurality of rearwardly-projecting ribs 212 that extend radially outwardly at substantially equally angularly spaced intervals from the generally circular central hub 208 to the generally rectangular annular rim 210. As shown in FIG. 6, the plurality of ribs 212 define a plurality of relatively large openings 214. The large openings 214 in the dome-shaped side wall 206 not only reduce the weight of the housing 202, but also allow air to circulate therethrough to cool the diaphragm 246 and the associated driver 266. The generally rectangular flat side wall 204 includes a generally rectangular annular rim 216 along its outer periphery. The annular rim 216 of the side wall 204 and the annular rim 210 of the side wall 206 are removably joined along a seam 218 by suitable fasteners (not shown), such as screws. A spring 268 is interposed between diaphragm 246 and hub 208 and is maintained in a state of compression therebetween. Ends of the spring 268 are received in respective grooves formed in the diaphragm 246 and the hub 208.

The generally rectangular annular rim 210 of the dome-shaped side wall 206 defines a diaphragm opening 236 as shown in FIG. 6. A generally rectangular diaphragm 246 is positioned across the diaphragm opening 236. The diaphragm 246 includes a relatively rigid generally rectangular diaphragm plate or piston 250 and a relatively flexible diaphragm seal 252 interposed between an outer periphery of the diaphragm plate 250 and an inner periphery of the generally rectangular annular rim 210. The diaphragm 246 and the generally flat side wall 204 define an air chamber 254. The diaphragm seal 252 forms a substantially fluid-tight seal between the outer periphery of the generally rectangular diaphragm plate 250 and the inner periphery of the generally rectangular annular rim 210.

As shown in FIG. 6, in the illustrated embodiment, a generally circular central hub 220 extends rearwardly from each diaphragm plate 250 and a generally rectangular peripheral rim 222 extends rearwardly from a perimeter edge of each diaphragm plate 250. A plurality of rearwardly-projecting ribs 224 extend radially outwardly at generally equally angularly spaced intervals from the central hub 220 to the generally rectangular peripheral rim 222. The diaphragm seal 252 has a first straight portion 228 that is secured to the inwardly-facing surface of the generally rectangular annular rim 210 of the housing 202, a second straight portion 230 that is secured to the outwardly-facing surface of the generally rectangular peripheral rim 222 of the diaphragm plate 250, and an intermediate curved portion 232 that joins the first and second straight portions 228, 230 of the diaphragm seal 252. The diaphragm seal 252 may be made from any suitable flexible material, such as rubber. The diaphragm seal 252 not only supports the diaphragm plate 250 relative to the housing 202, but also allows the diaphragm plate 250 to be moved laterally toward and away from wall 204, as indicated in FIG. 6 by a double headed arrow 256, to pulse the air in the chamber 254 between high and low pressures. In addition, the diaphragm seal 252 urges the diaphragm plate 250 to return to a neutral position after moving.

The annular rim 216 of the housing 202 has a blower inlet 258 in communication with the air chamber 254. The flat side wall 204 of the housing 202 has an air port 260 in communication with the air chamber 254. The blower inlet 258 is connectible to the blower 36 via a line 38 and the air port 260 is connectible to the inflatable garment 42 via a line 44. A check valve (not shown) is coupled to the blower inlet 258 in some embodiments and is omitted in other embodiments. The check valve allows pressurized air from the blower 36 to flow to the air chamber 254 to establish a baseline pressure therein. However, the check valve automatically closes when the pressurized air from the air chamber 254 attempts to flow back toward the blower 36 in the reverse direction, for example, when the pressure in the air chamber 254 increases in response to the diaphragm 246 moving toward the side wall 204. In the illustrated embodiment, the housing 202 and the diaphragm plate 250 are both made from ABS (Acrylonitrile Butadiene Styrene) plastic, although any material, such as other plastic materials and/or metal materials, that have sufficient strength and durability may be used.

The air pulse generator 200 includes a driver 266 coupled to the diaphragm 246. The driver 266 is operable to cause reciprocating motion of the diaphragm 246, as shown by the double headed arrow 256, relative to wall 204. This causes the pressurized air in the chamber 254 to pulse by repetitively increasing and decreasing the air pressure about the baseline pressure. The air pulse generator 200 includes a coil spring 268 interposed between the diaphragm plate 250 and the central hub 208 of the dome-shaped side wall 206 to bias the diaphragm plate 250 away from the side wall 206.

In the embodiment illustrated in FIGS. 6-8, the driver 266 comprises a BEI Kimco Magnetics voice coil actuator, Model No. LA25-42-000A. This motor produces a peak force of about 60 lbs. and a continuous stall force of about 19.4 lbs. In the illustrated embodiment, some of the air from the blower 36 is diverted to cool the motor. The driver 266 comprises an oscillating current-carrying coil (not shown) coupled to the diaphragm plate 250 and a permanent magnet (not shown) coupled to a housing 270 of the driver 266. The housing 270 of the driver 266 is supported by the central hub 208 of the dome-shaped side wall 206. The current-carrying coil has a pair of leads through which an oscillating current is applied to the coil. The coil extends outwardly from the diaphragm plate 250. The magnet extends inwardly from the housing 270. The magnet has a ring-shaped body defining an interior space and the coil is located in the interior space defined by the ring-shaped body. The coil spring 268 has a large diameter bore and the housing 270 is located in the large diameter bore.

Figure 9:
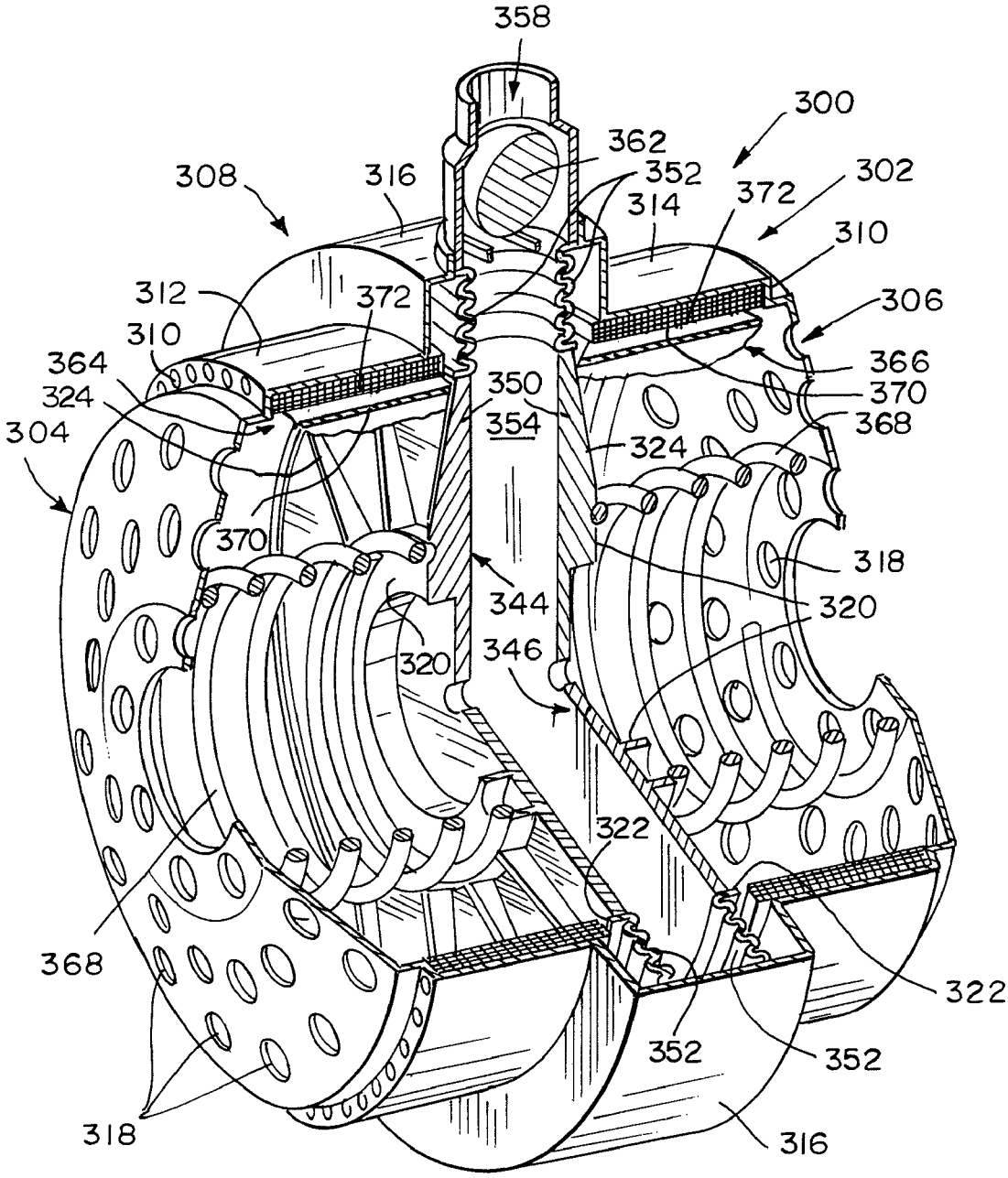
FIG. 9 is a perspective view, with portions broken away, of a third embodiment of the air pulse generator of FIG. 1 showing a housing having oppositely-disposed first and second side walls and an annular rim extending between the first and second side walls, first and second generally disc-shaped diaphragms located near the first and second side walls, the first and second diaphragms and the annular rim defining an air chamber having an air port and a blower inlet, first and second drivers operable to move the first and second diaphragms, first and second springs interposed between the first and second diaphragms and the first and second side walls, each driver comprising an oscillating current-carrying coil coupled to an associated diaphragm and a DC current-carrying coil supported by the annular rim.
Figure 11:
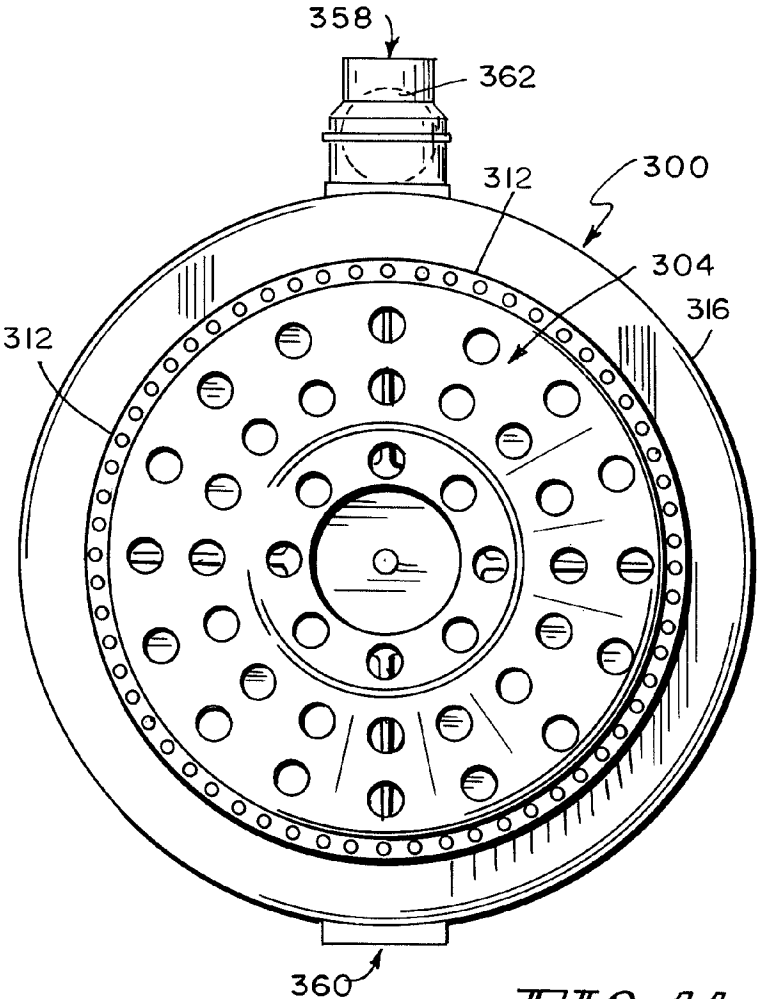
FIG. 11 is a side elevation view of the air pulse generator of FIG. 9.
Figure 10:
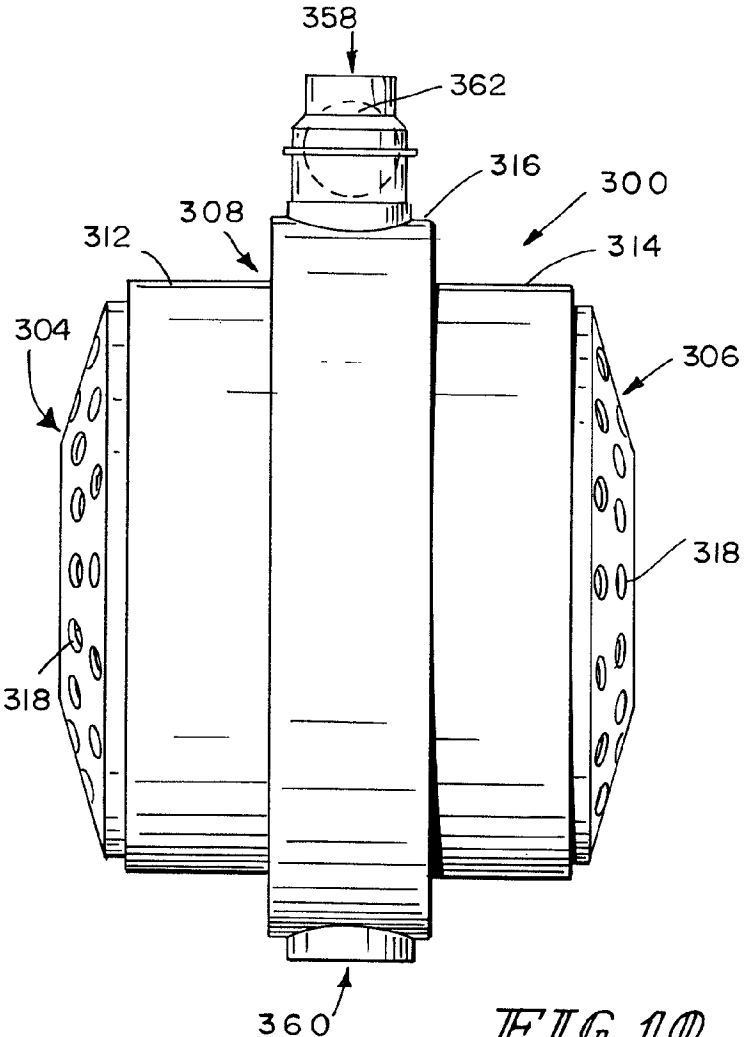
FIG. 10 is a front elevation view of the air pulse generator of FIG. 9.

FIGS. 9-12 show a third embodiment 300 of the air pulse generator 32. The air pulse generator 300 of FIGS. 9-12 is generally similar to the air pulse generator 100 of FIGS. 1-5, except that drivers 364, 366 of the air pulse generator 300 do not use permanent magnets. Instead, the drivers 364, 366 use driver coils 372 which interact with associated voice coils 370 to produce reciprocating motion of respective diaphragms 344, 346. As shown in FIGS. 9-12, the air pulse generator 300 includes a generally tubular housing or shell 302 comprising oppositely-disposed first and second side walls 304, 306 and an annular rim 308 extending between the first and second side walls 304, 306. In the illustrated embodiment, each side wall 304, 306 is generally round and slightly outwardly convex. The annular rim 308 comprises oppositely-disposed first and second cylindrical portions 312, 314 having a relatively small diameter and an intermediate cylindrical portion 316 having a relatively large diameter. The outside diameters of the first and second side walls 304, 306 and the outside diameters of the first and second cylindrical portions 314, 316 are about equal. The first and second side walls 304, 306 and the first and second cylindrical portions 314, 316 are removably joined along respective seams 310 by suitable fasteners, such as screws. As shown in FIG. 9, the first and second side walls 304, 306 have a plurality of openings 318, which not only reduce the weight of the housing 302, but also allow the outside air to circulate therethrough to cool the diaphragms 344, 346 and drivers 364, 366.

Figure 12:
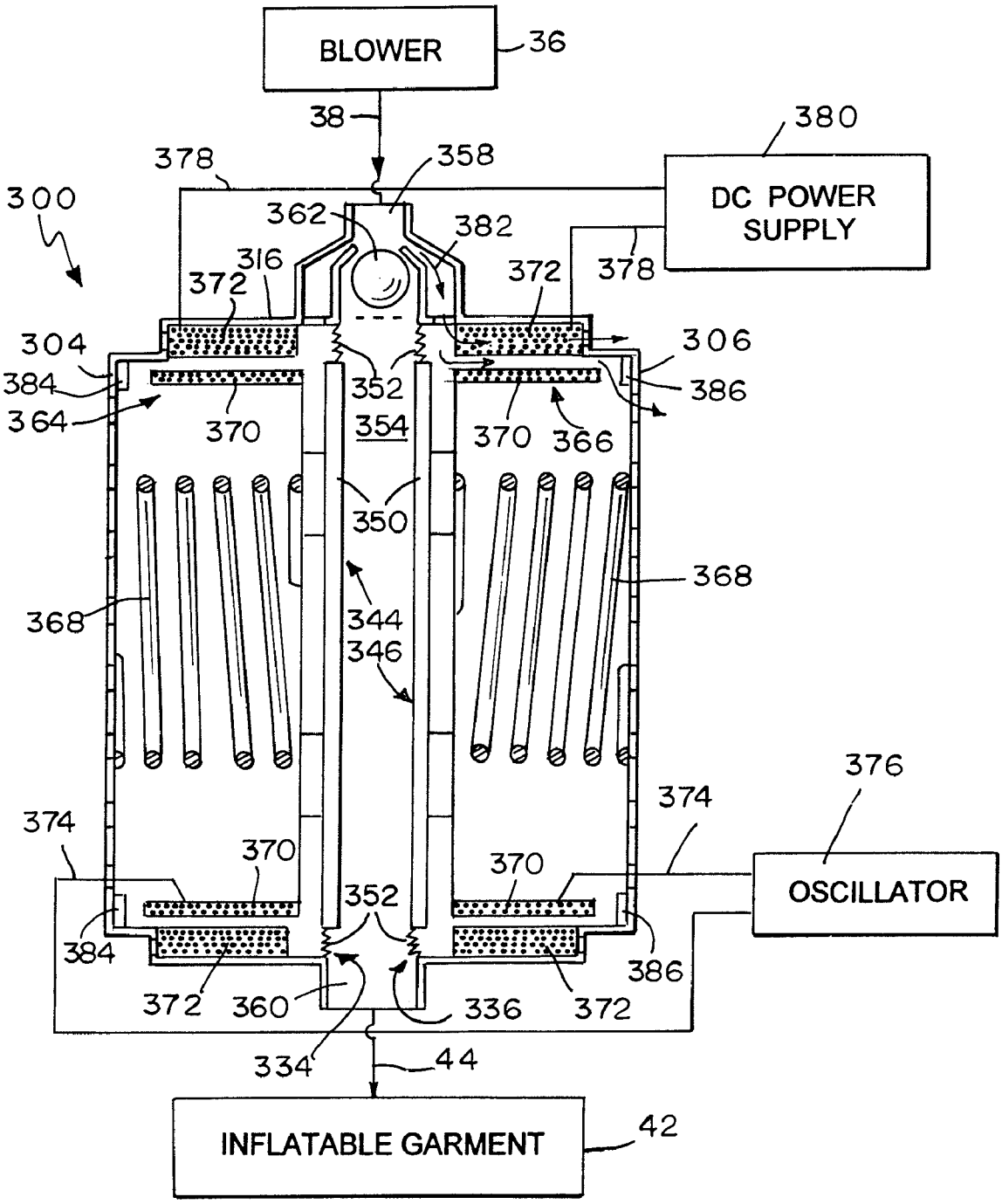
FIG. 12 is a diagrammatic view of the third embodiment of the air pulse generator of FIG. 9.

As shown diagrammatically in FIG. 12, the intermediate cylindrical portion 316 defines first and second diaphragm openings 334, 336, respectively. A first diaphragm 344 is positioned across the first diaphragm opening 334. A second diaphragm 346 is positioned across the second diaphragm opening 336. Each diaphragm 344, 346 includes a relatively rigid generally circular diaphragm plate or piston 350 and an annular relatively flexible diaphragm seal 352 interposed between an outer periphery of the diaphragm plate 350 and an inner periphery of the intermediate cylindrical portion 316. The two opposed diaphragms 344, 346 and the intermediate cylindrical portion 316 define an air chamber 354. Each diaphragm seal 352 forms a substantially fluid-tight seal between the outer periphery of the diaphragm plate 350 and the inner periphery of the intermediate cylindrical portion 316.

As shown in FIG. 9, in the illustrated embodiment, a generally circular central hub 320 extends rearwardly from each diaphragm plate 350 and an annular rim 322 extends rearwardly from a perimeter edge of each diaphragm plate 350. A plurality of rearwardly-projecting ribs 324 extend radially outwardly at generally equally angularly spaced intervals from the central hub 320 to the annular rim 322. Illustratively, each diaphragm seal 352 is fluted or corrugated. The diaphragm seals 352 not only support the diaphragm plates 350 relative to the housing 302, but also allow the diaphragm plates 350 to be moved toward and away from each other, as shown by double headed arrows 356, to pulse the air in the chamber 354. In addition, the diaphragm seals 352 urge the diaphragm plates 350 to return to their respective neutral positions after moving.

As shown diagrammatically in FIG. 12, the intermediate cylindrical portion 316 of the housing 302 has a blower inlet 358 in communication with the air chamber 354 and an air port 360 in communication with the air chamber 354. In the illustrated embodiment, the blower inlet 358 and the air port 360 are positioned on opposite sides of the intermediate cylindrical portion 316. The blower inlet 358 is connectible to the blower 36 via a line 38 and the air port 360 is connectible to the inflatable garment 42 via a line 44. A check valve 362 is coupled to the blower inlet 358. The check valve 362 allows pressurized air from the blower 36 to flow to the air chamber 354 to establish a baseline pressure in the air chamber 354 and in the inflatable garment 42. However, the check valve 362 automatically closes when the pressurized air from the air chamber 354 attempts to flow back toward the blower 36 in the reverse direction, for example, when the pressure in the air chamber 354 increases in response to the diaphragms 344, 346 moving toward each other. In some embodiments, check valve 362 is omitted. In the illustrated embodiment, the housing 302 is a steel case and the diaphragm plates 350 are made from ABS (Acrylonitrile Butadiene Styrene) plastic, although any material, such as other plastic materials and/or metal materials, that have sufficient strength and durability may be used.

As shown diagrammatically in FIG. 12, the air pulse generator 300 includes first and second drivers 364, 366 coupled to the first and second diaphragms 344, 346. The drivers 364, 366 are operable to move the diaphragms 344, 346 in the opposite directions relative to each other. This causes the pressurized air in the chamber 354 to pulse by repetitively increasing and decreasing the air pressure about the baseline pressure. The air pulse generator 300 includes coil springs 368 for biasing the diaphragm plates 350 away from the associated side walls 304, 306. The coil springs 368 are in a state of compression between the diaphragm plates 350 and the associated side walls 304, 306.

Illustratively, as shown diagrammatically in FIG. 12, each driver 364, 366 comprises an oscillating current-carrying coil 370 coupled to an associated diaphragm plate 350 and a DC current-carrying coil 372 coupled to an associated side wall 304, 306. Each current-carrying coil 370 has a pair of leads 374 connected to an oscillator 376, which causes an oscillating current to flow through the associated coil 370. Each DC current-carrying coil 372 has a pair of leads 378 connected to a DC power supply 380, which causes a DC current to flow through the associated coil 372. Each oscillating current-carrying coil 370 extends outwardly from an associated diaphragm plate 350. Each DC current-carrying coil 372 extends inwardly from an associated side wall 304, 306. As diagrammatically shown in FIG. 12, in some embodiments, the air pulse generator 300 includes first and second bumpers 384, 386 coupled to the respective walls 304, 306 of the housing 302. The bumpers 384, 386 protect the oscillating current-carrying coils 370 from accidental contact with the walls 304, 306 of the housing 302.

The DC current-carrying coil 372 has a first ring-shaped body defining an interior space and the associated oscillating current-carrying coil 370 is located in the interior space of the first ring-shaped body. The oscillating current-carrying coil 370 has a second ring-shaped body defining an interior space and the associated coil spring 368 is located in the interior space of the second ring-shaped body. As shown diagrammatically in FIG. 12, a portion 382 of blower air is diverted to the driver coils 372 to cool the driver coils 372. The openings 314 in the side walls 304, 306 of the housing 302 not only reduce the weight of the air pulse generator 300, but also cause the ambient air to flow therethrough to cool the diaphragms 344, 346, and the coils 370 attached thereto. Springs 368 are situated, in part, within the interior regions of the associated coils 370

Illustratively, the drivers 364, 366 are BEI Kimco Magnetics voice coil actuators. The oscillating and DC current-carrying coils 370, 372 are referred to as voice coils and driver coils, respectively. Illustratively, the parameters of the air pulse generator 300 are as follows: 1) driver force required per piston, about 14 lbs., 2) the voice coil diameter, about 5.45 inches, 3) active voice coil length, about 1 inch, 4) voice coil wire weight, about 0.1049 lbs., 5) the driver coil diameter, about 5.49 inches, 6) the driver coil length, about 1.5 inches, 7) driver coil wire weight, about 1.272 lbs., and 8) driver coil power dissipation, about 400 watts.

Use of springs 168, 268, 368 in the air pulse generator embodiments 100, 200, 300 described above helps to improve the efficiency of the air pulse generator. That is, for any particular amount of air to be displaced in an air pulse, for example, 29 cubic inches of air, a smaller driver can be used to oscillate the associated diaphragms if springs 168, 268, 368 are provided than if springs 168, 268, 368 are not provided. The springs 168, 268, 368 assist the respective drivers in moving the associated diaphragms in the direction in which air is pressurized and forced out of the associated air chamber. Use of smaller drivers allows the weight of the air pulse generators 100, 200, 300 to be reduced. One suitable spring for use in air pulse generators 100, 200, 300 has a free length of about 2.5 inches; has a spring rate of about 17.5 lbs/inch; has a mean spring diameter (D) of 2.6 inches; has a spring wire diameter (d) of about 0.175 inch; has an internal diameter of about 2.425 inches; has a pitch of about 0.45 inch; has 4.389 active coils; has a modulus of rigidity of $1.15\times10^7$ psi; has a spring index (C=D/d) of 14.857; has a solid length of about 1.293 inches; has a maximum displacement of about 1.207 inches; and has a natural frequency of about 74.86 Hertz.

Figure 20:
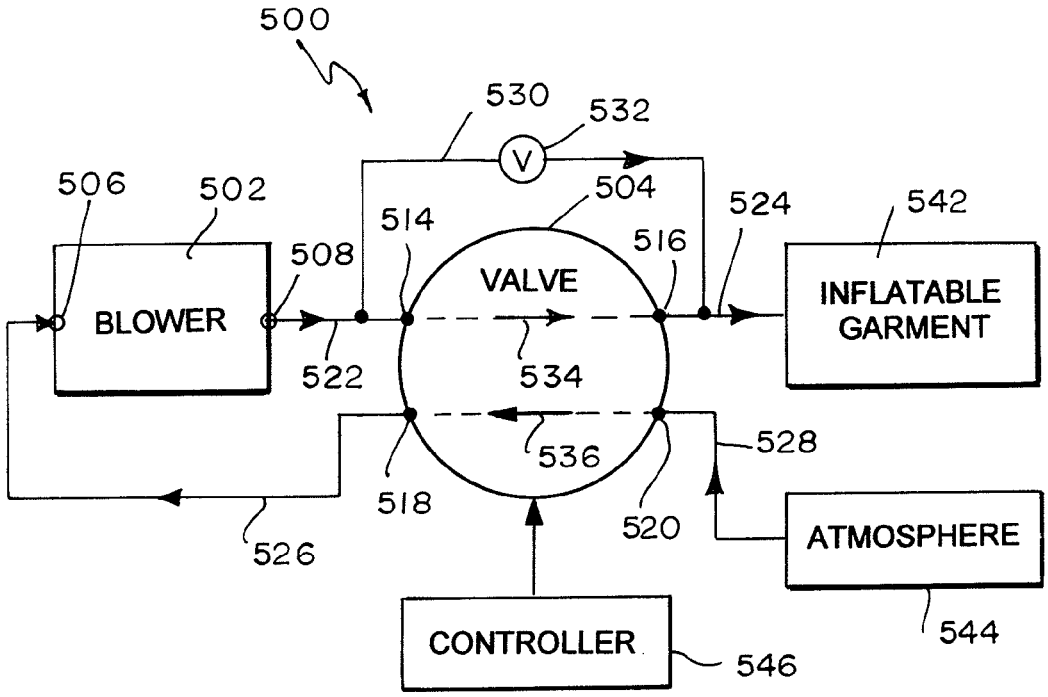
FIGS. 20 and 21 are diagrammatic views of a fifth embodiment of the air pulse generator of FIG. 1 showing a solenoid-controlled flapper valve coupled to a blower and coupled to an inflatable garment to alternatively force air into (FIG. 20) and draw air out of (FIG. 21) the inflatable garment.
Figure 21:
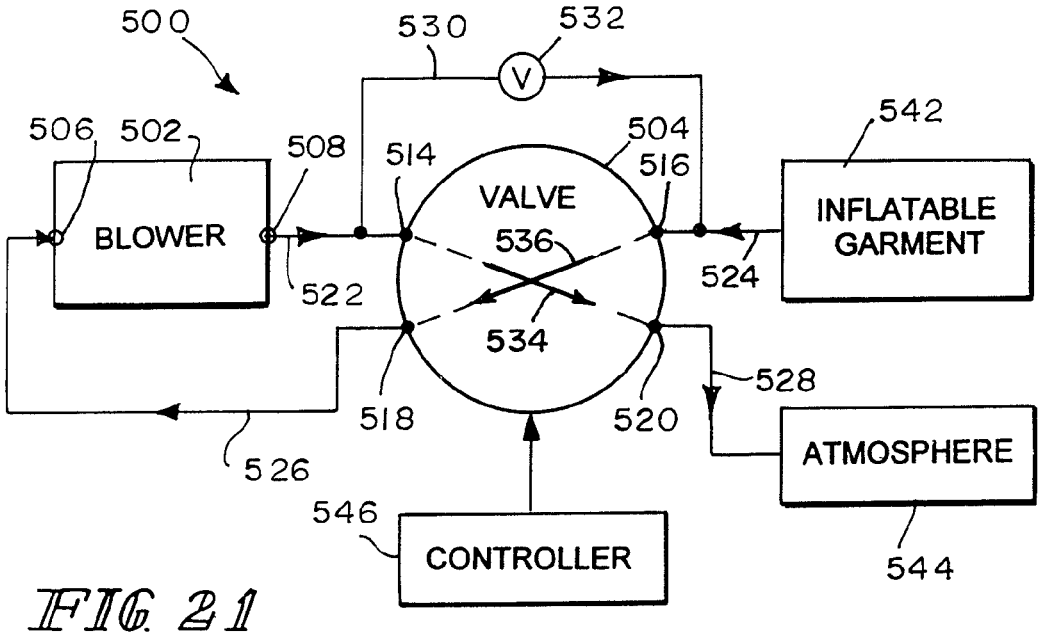
Figure 22:
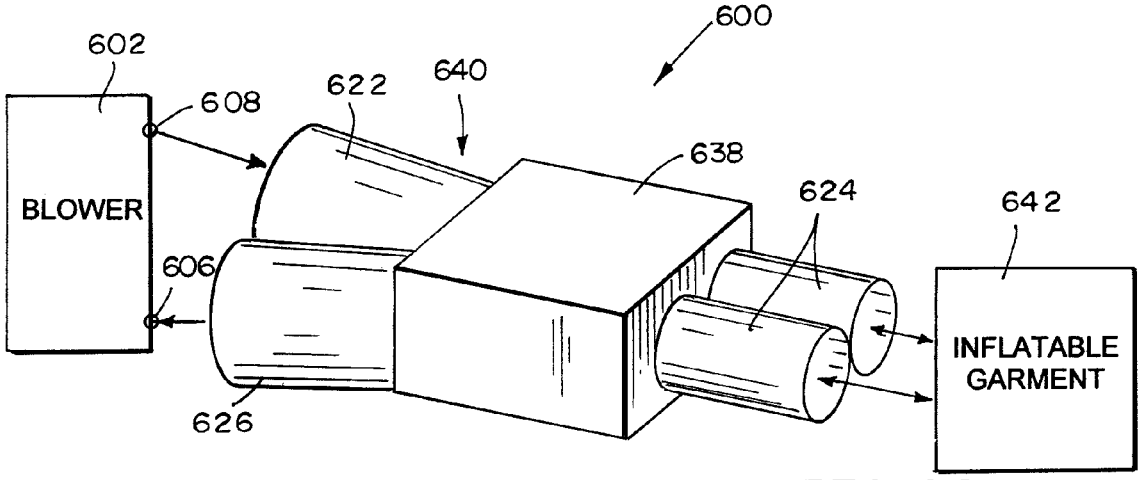
FIG. 22 is a perspective view of a sixth embodiment of the air pulse generator of FIG. 1, generally similar to the air pulse generator of FIGS. 20-21, comprising a solenoid-controlled flapper valve situated within a tube assembly which is coupled to a blower (shown diagrammatically) and coupled to an inflatable garment (shown diagrammatically)
Figure 23:
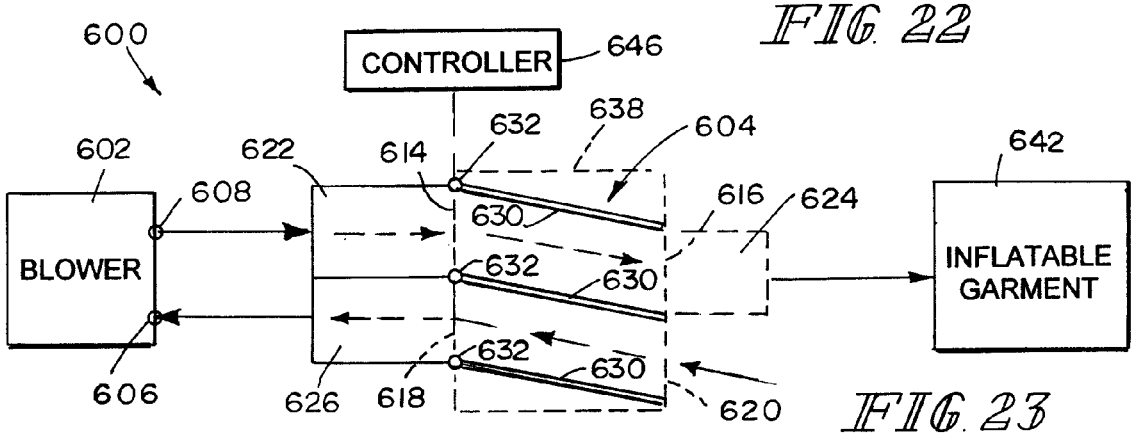
FIGS. 23 and 24 are diagrammatic views of the air pulse generator of FIG. 22 showing the flapper valve alternatively forcing air into (FIG. 23) and drawing air out of (FIG. 24) the inflatable garment.
Figure 24:
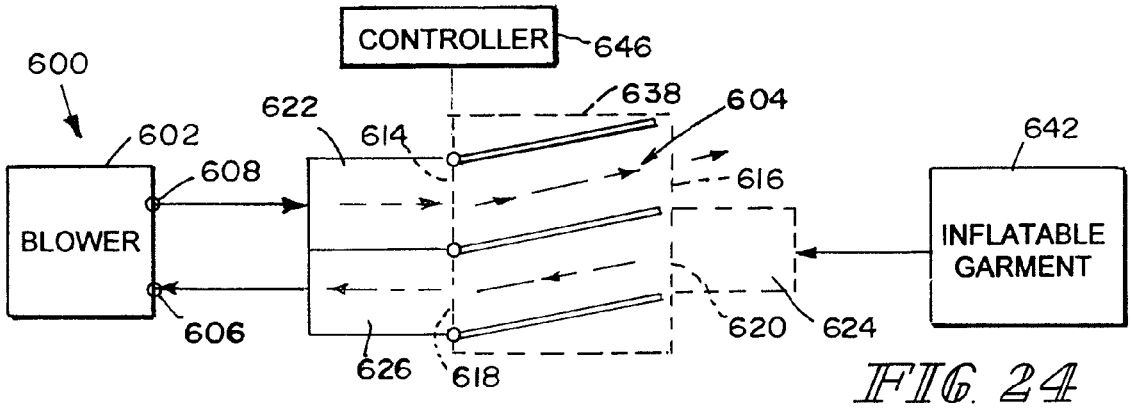

FIGS. 13-19 show a fourth embodiment 400 of the air pulse generator 32. FIGS. 20-21 show a fifth embodiment 500 of the air pulse generator 32. FIGS. 22-24 show a sixth embodiment 600 of the air pulse generator 32. Contrary to the first, second and third embodiments shown in FIGS. 1-12, the air pulse generators 400, 500, and 600, each include a blower and a valve coupled to the blower. Thus, the air pulse generator 400 shown in FIGS. 13-19 includes a blower 402 and a rotary valve 404 coupled to the blower 402, while the air pulse generator 500 shown in FIGS. 20-21 includes a blower 502 and a flapper valve 504 coupled to the blower 502 and the air pulse generator 600 shown in FIGS. 22-24 includes a blower 602 and a flapper valve 604 coupled to the blower 602.

Figure 17:
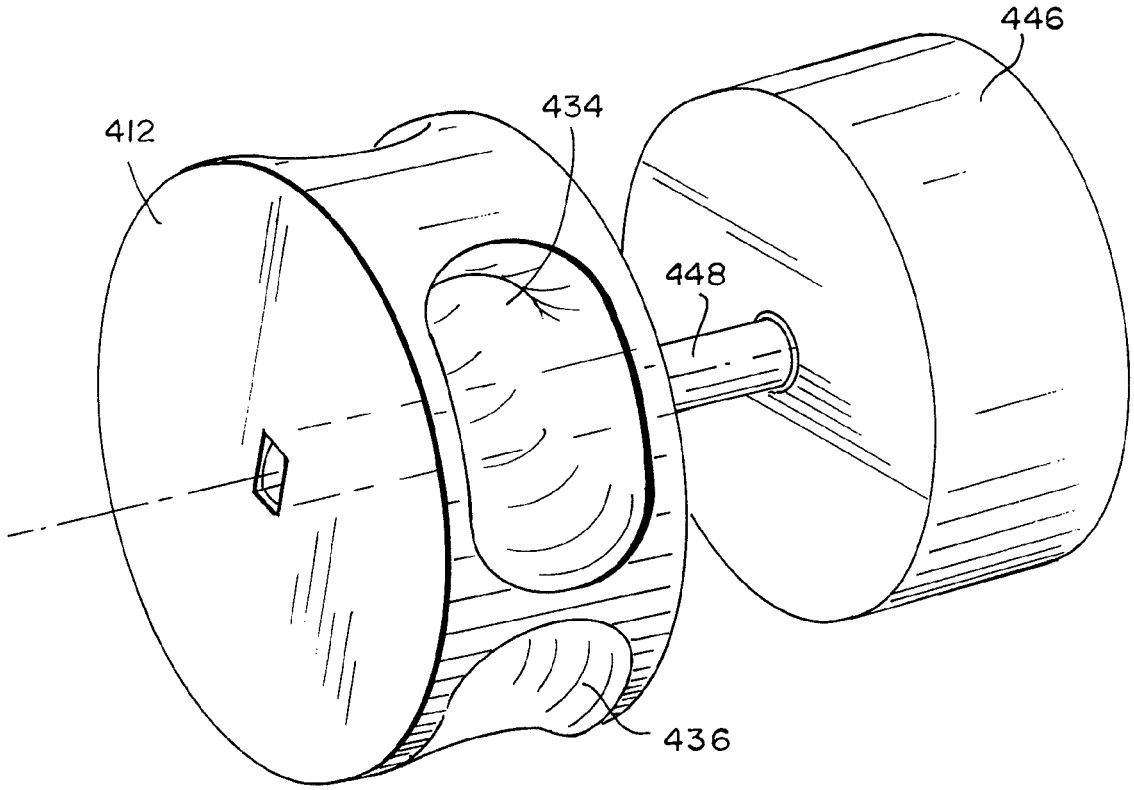
FIG. 17 is a perspective view of a motor and a rotor of the rotary valve of FIG. 13.
Figure 19:
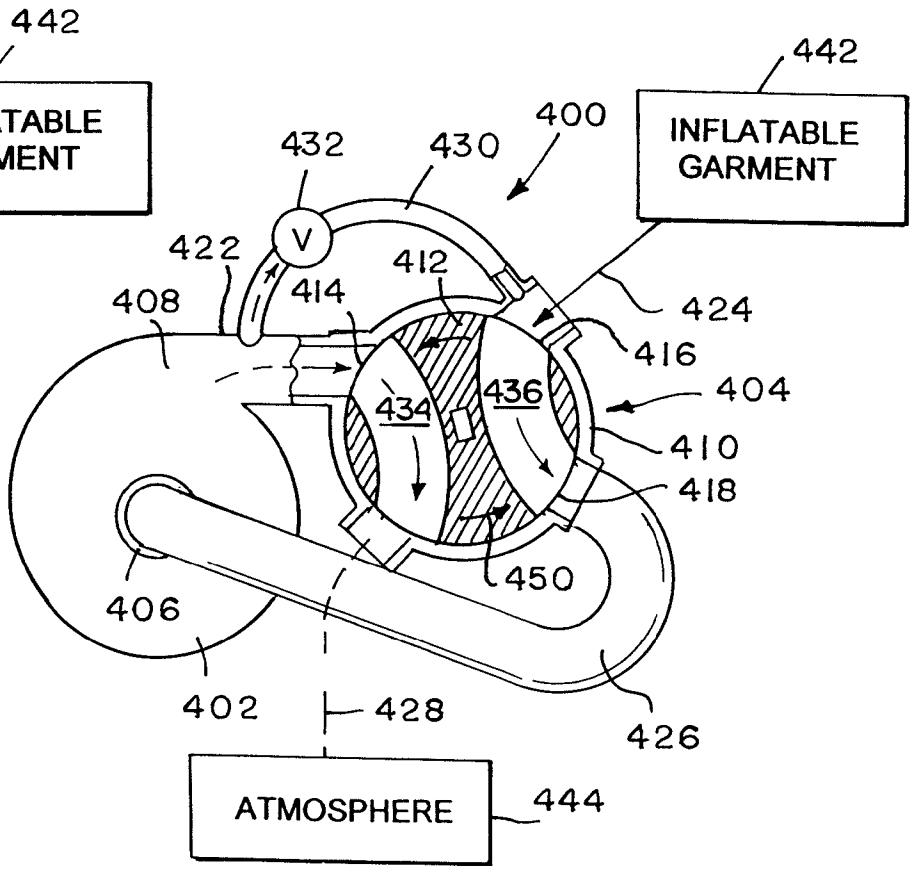
FIG. 19 is a diagrammatic view of the air pulse generator of FIG. 13 showing the rotor in a second position to draw air out of the inflatable garment.
Figure 18:
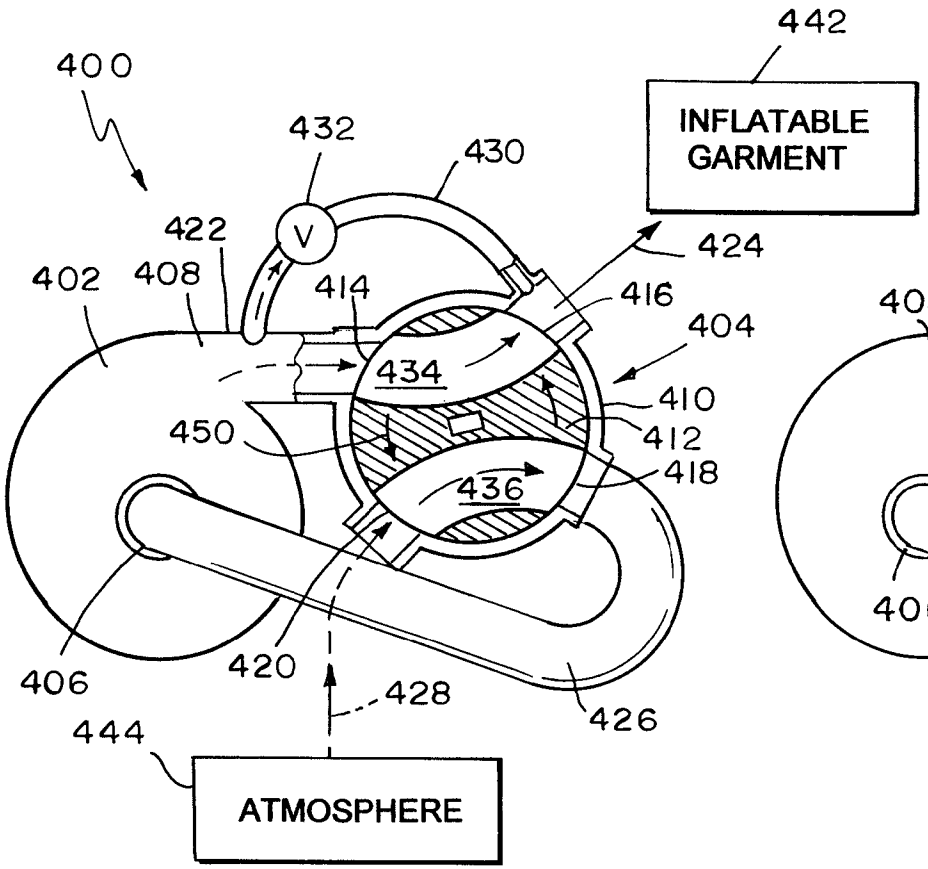
FIG. 18 is a diagrammatic view of the air pulse generator of FIG. 13 showing the rotor in a first position to force air into the inflatable garment.

As shown diagrammatically in FIGS. 18-19, a rotary valve 404 is coupled to an inflatable garment 442 via a line 424 and rotates to alternatively force air into the inflatable garment 442 (FIG. 18) and to draw air out of the inflatable garment 442 (FIG. 19). A blower 402 has an inlet port 406 and an outlet port 408. The rotary valve 404 includes a housing 410 having an interior region and a rotor 412 (FIG. 17) located in the interior region for rotation relative to the housing 410. With continuing reference to FIGS. 18-19, the housing 410 has a first port 414 coupled to the blower outlet port 408 via a first line 422, a second port 416 coupled to the inflatable garment 442 via a second line 424, a third port 418 coupled to the blower inlet port 406 via a third line 426, and a fourth port 420 coupled to the atmosphere 444 via a fourth line 428.

Figure 13:
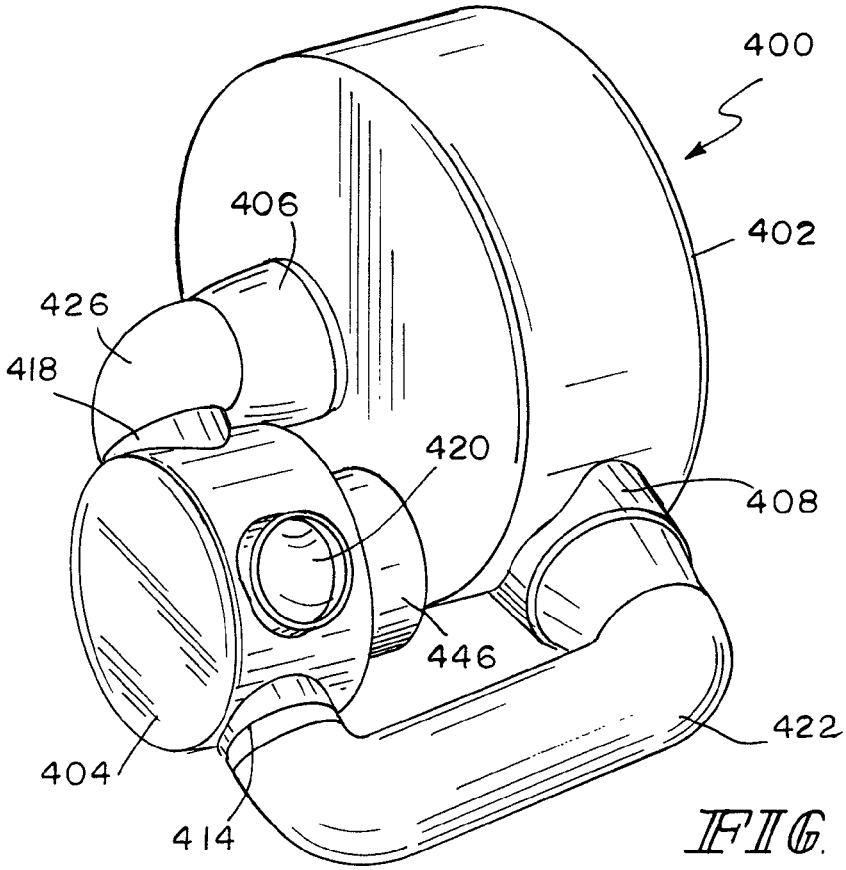
FIG. 13 is a perspective view of a fourth embodiment of the air pulse generator of FIG. 1 showing a rotary valve coupled to a blower and operable to apply oscillating pressure to an inflatable garment (not shown)
Figure 14:
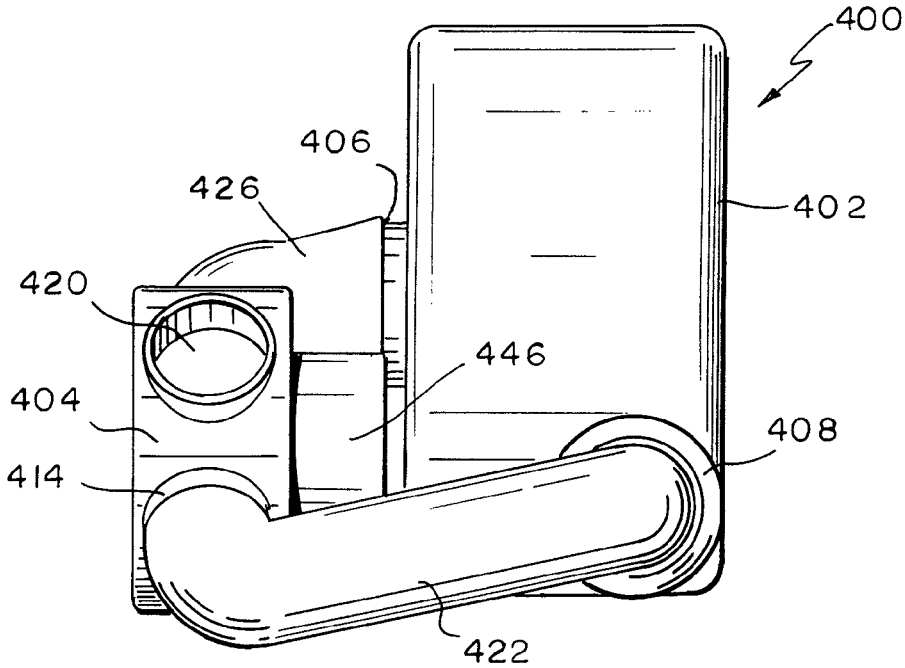
FIG. 14 is a front elevation view of the air pulse generator of FIG. 13.
Figure 16:
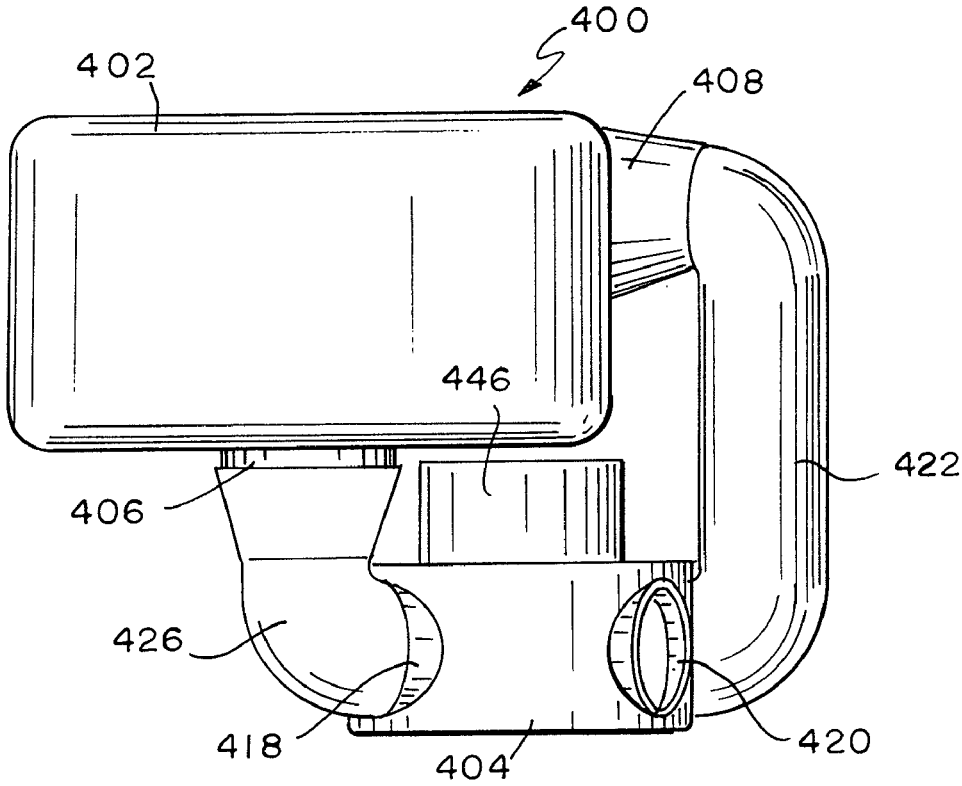
FIG. 16 is a top plan view of the air pulse generator of FIG. 13.
Figure 15:
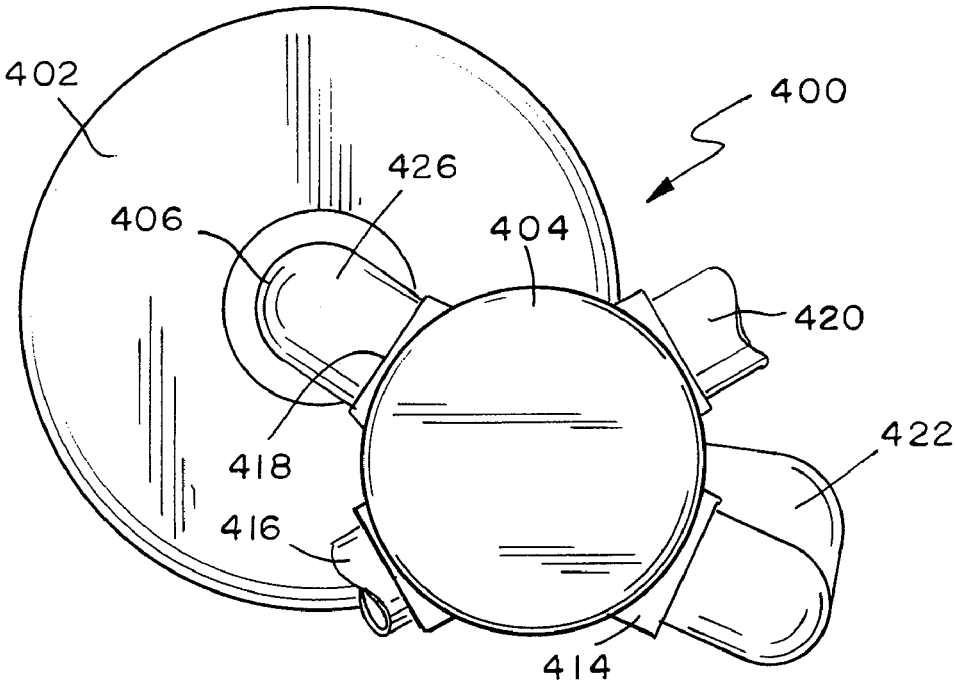
FIG. 15 is a side elevation view of the air pulse generator of FIG. 13.

As shown in FIGS. 17-19, the rotor 412 has first and second internal passageways 434, 436. The rotor 412 is mounted on a drive shaft 448 (FIG. 17) which is driven by a suitable motor 446 (FIG. 13). As shown in FIG. 18, in a first position of the rotor 412 relative to the housing 410, the first passageway 434 couples the first port 414 to the second port 416 to couple the blower outlet port 408 to the inflatable garment 442 and the second passageway 436 couples the third port 418 to the fourth port 420 to couple the blower inlet port 406 to the atmosphere 444, so that the air is forced into the inflatable garment 442. In FIG. 19, the rotor 412 has turned about 90° in a counterclockwise direction 450 from its position in FIG. 18. As shown in FIG. 19, in a second position of the rotor 412 relative to the housing 410, the first passageway 434 couples the first port 414 to the fourth port 420 to couple the blower outlet port 408 to the atmosphere 444 and the second passageway 436 couples the second port 416 to the third port 418 to couple the inflatable garment 442 to the blower inlet 406, so that the air is drawn out of the inflatable garment 442. It should be appreciated that even when a negative pressure is applied to garment via valve 404, the actual pressure inside garment 442 will typically remain above atmospheric pressure.

After another 90° turn of the rotor 412 from the position shown in FIG. 19, the second passageway 436 moves to the position (FIG. 18) previously occupied by the first passageway 434 and the first passageway 434 moves to the position (FIG. 18) previously occupied by the second passageway 434. In this third position, the second passageway 436 couples the first port 414 to the second port 416 to couple the blower outlet port 408 to the inflatable garment 442 and the first passageway 434 couples the third port 418 to the fourth port 420 to couple the blower inlet port 406 to the atmosphere 444 to force air into the inflatable garment 442. After another 90° turn of the rotor 412, the second passageway 436 moves to the position (FIG. 19) previously occupied by the first passageway 434 and the first passageway 434 moves to the position (FIG. 19) previously occupied by the second passageway 434. In this fourth position, the second passageway 436 couples the first port 414 to the fourth port 420 to couple the blower outlet port 408 to the atmosphere 444 and the first passageway 434 couples the second port 416 to the third port 418 to couple the inflatable garment 442 to the blower inlet 406 to draw air out of the inflatable garment 442.

Thus, the rotary valve 404 repetitively cycles between a first state, shown, for example, in FIG. 18, where the first port 414 is coupled to the second port 416 and the third port 418 is coupled to the fourth port 420 to blow air into the inflatable garment 442, and a second state, shown, for example, in FIG. 19, where the first port 414 is coupled to the fourth port 420 and the second port 416 is coupled to the third port 418 to extract air from the inflatable garment 442. The rate at which the rotary valve 404 cycles between the two positions is determined by the speed of rotation of the rotor 412 which, in the illustrated embodiment, varies between 300 to 1200 rpm (revolutions per minute). It is within the scope of this disclosure for the speed of rotation of the rotor 412 to be set by the user.

As shown in FIGS. 18-19, the air pulse generator includes a bypass line 430 coupling the blower output line 422 to the inflatable garment input line 424 and a control valve 432 coupled to the bypass line 430. The control valve 432 is operable to set a baseline pressure in the inflatable garment 442. In the illustrated embodiment, the blower 402 comprises a centrifugal blower with a maximum pressure output of about 1.2 psid (pounds per square inch differential) and a sufficient flow capacity to respond at 20 hz (hertz). Illustratively, the blower 402 is an Ametek centrifugal blower, Model No. 116644, weighing about 3.75 lbs. Illustratively, the rotor 412 is made from ABS (Acrylonitrile Butadiene Styrene) plastic, although any material, such as other plastic materials and/or metal materials, that have sufficient strength and durability may be used. Illustratively, the outside dimensions of the air pulse generator 400 are as follows: 1) height, about 6.456 inches, 2) length, about 8.094 inches, 3) width, about 6.030 inches, and 4) the blower diameter, about 5.880 inches.

FIGS. 20-21 diagrammatically show the fifth embodiment 500 of the air pulse generator 32. As previously indicated, the air pulse generator 500 includes a blower 502 and a solenoid-operated flapper valve 504 coupled to the blower 502. The air pulse generator 500 of FIGS. 20-21 is generally similar to the air pulse generator 400 of FIGS. 13-19, except that the air pulse generator 500 uses a solenoid-operated flapper valve 504 instead of a motor-driven rotary valve 404. As diagrammatically shown in FIGS. 20-21, the flapper valve 504 is coupled to an inflatable garment 542 via a line 524 to alternatively force air into and draw air out of the inflatable garment 542. The blower 502 has an inlet port 506 and an outlet port 508. The flapper valve 504 has a first port 514 coupled to the blower outlet port 508 via a first line 522, a second port 516 coupled to the inflatable garment 542 via a second line 524, a third port 518 coupled to the blower inlet port 506 via a third line 526, and a fourth port 520 coupled to the atmosphere 544 via a fourth line 528.

In response to an electrical signal from a controller 546, the flapper valve 504 repetitively cycles between a first position shown in FIG. 20 and a second position shown in FIG. 21 at a user-selected rate. As shown in FIG. 20, in the first position of the flapper valve 504, the first port 514 is coupled to the second port 516 to couple the blower outlet port 508 to the inflatable garment 542 and the third port 518 is coupled to the fourth port 520 to couple the blower inlet port 506 to the atmosphere 544, so that the air is forced into the inflatable garment 542. As shown in FIG. 21, in the second position of the flapper valve 504, the first port 514 is coupled to the fourth port 520 to couple the blower outlet port 408 to the atmosphere 544 and the second port 516 is coupled to the third port 518 to couple the inflatable garment 542 to the blower inlet 506, so that the air is drawn out of the inflatable garment 542. Thus, the flapper valve 504 alternatively blows air into the inflatable garment 542 and draws air from the inflatable garment 542 as the controller 546 cycles the flapper valve 504 between the two positions at a user-selected rate. The air pulse generator 500 includes a bypass line 530 coupling the blower output line 522 to the inflatable garment input line 524 and a control valve 532 coupled to the bypass line 530. The control valve 532 is operable to set a baseline pressure in the inflatable garment 542. In the illustrated embodiment, the blower 502 is an Ametek centrifugal blower, Model No. 116644, weighing about 3.75 lbs.

FIGS. 22-24 show the sixth embodiment 600 of the air pulse generator 32. The air pulse generator 600 of FIGS. 22-24 is generally similar to the air pulse generator 500 of FIGS. 20-21. As diagrammatically shown in FIGS. 23-24, the air pulse generator 600 includes a blower 602 and a solenoid-operated flapper valve 604 coupled to the blower 602. The air pulse generator 600 further includes a tube assembly 640 shown in FIG. 22. The tube assembly 640 comprises a housing 638 in which the flapper valve 604 is located, a pair of tubes 622, 626 coupled to the housing 638 and coupled to the blower 602 and a pair of tubes 624 coupled to the housing 638 and coupled to the inflatable garment 642.

As diagrammatically shown in FIGS. 23-24, the blower 602 has an inlet port 606 and an outlet port 608. The flapper valve 604 comprises three pivoting plates 630, each of which is mounted to the housing 638 for pivoting movement about one end 632. The three plates 630 pivot in unison in response to an electrical signal from a controller 646. The flapper valve 604 has a first port 614 coupled to the blower outlet port 608 via the tube 622, a second port 616, which in a first position of the flapper valve 604 (FIG. 23) coupled to the inflatable garment 542 via the pair of tubes 624 and which in a second position of the flapper valve 604 (FIG. 24) coupled to the atmosphere, a third port 618 coupled to the blower inlet port 606 via the tube 626, and a fourth port 620, which in the first position of the flapper valve 604 (FIG. 23) coupled to the atmosphere and which in the second position of the flapper valve 604 (FIG. 24) coupled to the inflatable garment 542 via the pair of tubes 624.

The controller 646 is operable to repetitively cycle the flapper valve 604 between a first position shown in FIG. 23 and a second position shown in FIG. 24 at a user-selected rate. As shown in FIG. 23, in the first position of the flapper valve 604, the first port 614 is coupled to the second port 616 to couple the blower outlet port 608 to the inflatable garment 642 and the third port 618, which is coupled the blower inlet port 606, is vented to the atmosphere, so that air is forced into the inflatable garment 542. As shown in FIG. 24, in the second position of the flapper valve 604, the first port 614, which is coupled the blower outlet port 608, is vented to the atmosphere and the third port 618 is coupled to the fourth port 620 to couple the inflatable garment 642 to the blower inlet port 606, so that air is drawn out of the inflatable garment 642. Thus, the solenoid valve 604 alternatively blows air into the inflatable garment 642 and draws air out the inflatable garment 642 as the controller 646 cycles the flapper valve 604 between the two positions at a user-selected rate. The air pulse generator 600 includes a bypass line (similar to the bypass line 530 in FIGS. 20-21) coupling the blower output tube 622 to the inflatable garment input tubes 624 and a control valve (similar to the control valve 532 in FIGS. 20-21) coupled to the bypass line. The control valve is operable to set a baseline pressure in the inflatable garment 642.

Figure 25:
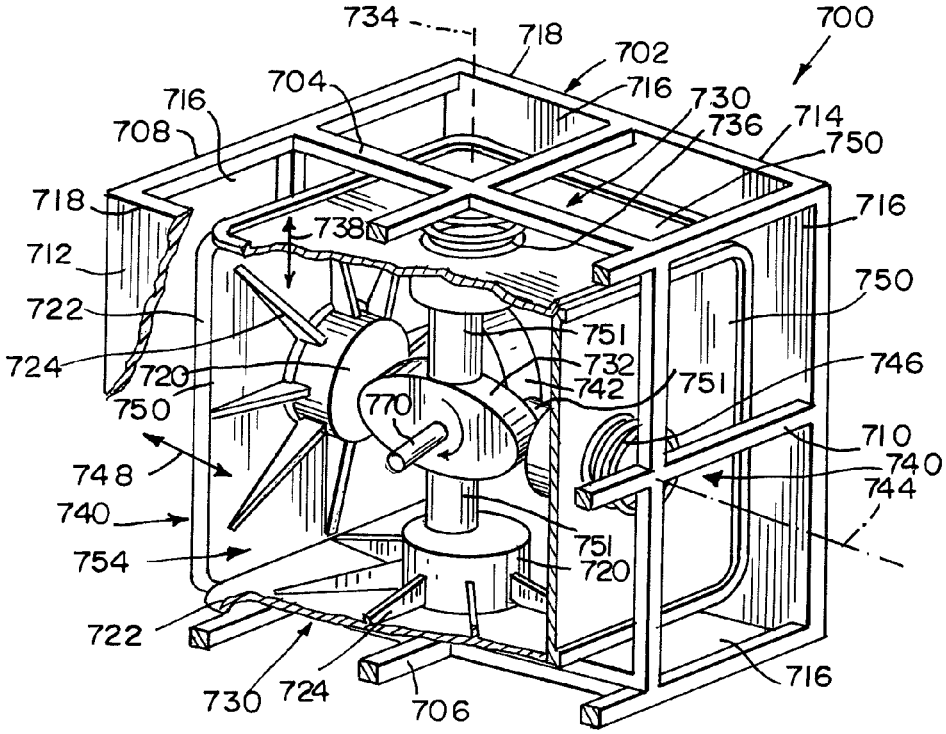
FIG. 25 is a perspective view, with portions broken away, of a seventh embodiment of the air pulse generator of FIG. 1 showing a generally box-shaped housing defining an air chamber, a first pair of opposed diaphragms and a second pair of opposed diaphragms, first and second generally elliptical cams mounted on a shaft for rotation therewith, the first cam being operable to move the first pair of opposed diaphragms toward and away from each other along a first axis, the second cam being operable to move the second pair of opposed diaphragms toward and away from each other along a second axis that is substantially perpendicular to the first axis, a first pair of springs arranged between the first pair of opposed diaphragms and the housing, and a second pair of springs arranged between the second pair of opposed diaphragms and the housing.
Figure 27:
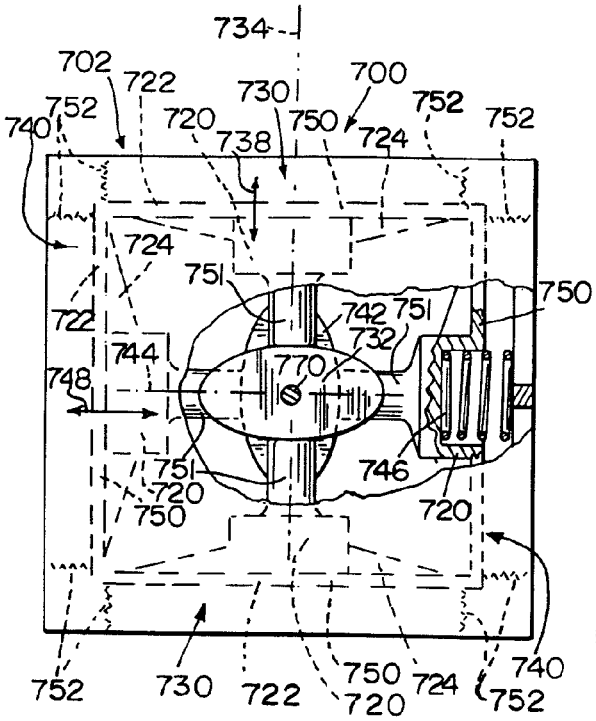
FIG. 27 is a front elevation view, with the front wall partially broken away, of the air pulse generator of FIG. 25.
Figure 26:
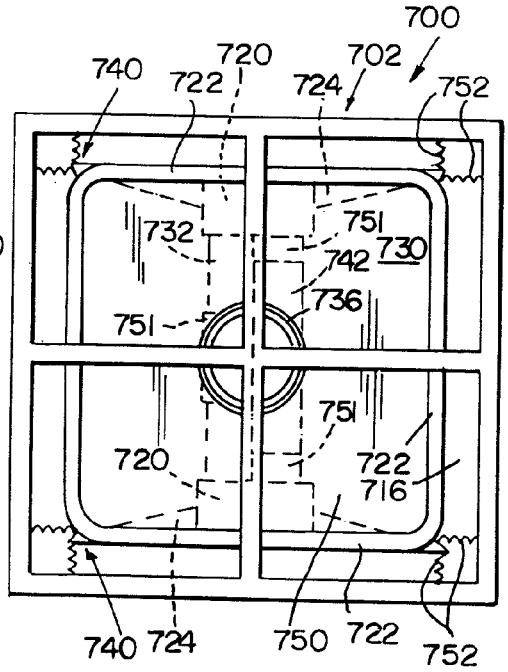
FIG. 26 is a top plan view of the air pulse generator of FIG. 25.

FIGS. 25-27 show a seventh embodiment 700 of the air pulse generator 32. The air pulse generator 700 is similar to the air pulse generators 100, 200, and 300 shown in FIGS. 5-12, except that the air pulse generator 700 uses a first cam 732 to move a first pair of diaphragms 730 and a second cam 742 to move a second pair of diaphragms 740. The air pulse generator 700 includes a generally box-shaped housing or shell 702 comprising a top wall 704, a bottom wall 706, a left side wall 708, a right side wall 710, a front wall 712, and a back wall 714. In the illustrated embodiment, the top, bottom and side walls 704, 706, 708, 710 each has four relatively large openings 716 arranged in a grid pattern as shown, for example, in FIG. 25. The large openings 716 in the walls 704, 706, 708, and 710 not only reduce the weight of the housing 702, but also allow the outside air to circulate therethrough to cool the diaphragms 730, 740. The front and back walls 712, 714 do not have any openings, except that the front wall 712 has a blower inlet (not shown) and an air port (not shown). The front and back walls 712, 714 are removably joined to the top, bottom and side walls 704, 706, 708, and 710 along respective seams 718 by suitable fasteners (not shown), such as screws.

In the embodiment illustrated in FIGS. 25-27, the air pulse generator 700 includes a first pair of opposed diaphragms 730, and a second pair of opposed diaphragms 740. In some embodiments, the air pulse generator 700 may very well include a single pair of diaphragms, instead of two pairs of diaphragms. As shown in FIG. 27, each diaphragm 730, 740 includes a relatively rigid diaphragm plate or piston 750, a relatively flexible diaphragm seal 752 interposed between the diaphragm plate 750 and the housing 702, and a piston rod 751 extending from piston 750 and contacting an associated cam 732, 742. In the illustrated embodiment, the diaphragm seals 752 not only support the diaphragm plates 750 relative to the housing 702, but also allow the diaphragm plates 750 to be reciprocated, as shown by double headed arrows 738, 748, along respective axes 734, 744 to pulse the air in the air chamber 754. In addition, in the illustrated embodiment, the diaphragm seals 752 urge the diaphragm plates 750 to return to their respective neutral positions after moving.

The first pair of diaphragms 730, the second pair of diaphragms 740, the front wall 712 and the back wall 714 define the air chamber 754. As shown in FIG. 25, in the illustrated embodiment, a generally circular central hub 720 extends rearwardly from each diaphragm plate 750 and an annular rim 722 extends forwardly from an outer perimeter of each diaphragm plate 750. A plurality of rearwardly-projecting ribs 724 extend radially outwardly at generally equally angularly spaced intervals from the central hub 720 toward the annular rim 722. The front wall 712 of the housing 702 has a blower inlet (not shown) coupled to the air chamber 754 and an air port (not shown) coupled to the air chamber 754. The blower inlet is connectible to the blower 36 via a line 38 and the air port is connectible to the inflatable garment 42 via a line 44. A check valve (not shown) is coupled to the blower inlet in some embodiments and is omitted in others. The check valve allows pressurized air from the blower 36 to flow to the air chamber 754 to establish a baseline pressure therein. However, the check valve automatically closes when the pressurized air from the air chamber 754 attempts to flow back toward the blower 36 in a reverse direction, for example, when the pressure in the air chamber 754 increases in response to the diaphragms 730, 740 moving inwardly toward the center of the housing 702. In the illustrated embodiment, the housing 702 and the diaphragm plates 750 are both made from ABS (Acrylonitrile Butadiene Styrene) plastic, although any material, such as other plastic materials and/or metal materials, that have sufficient strength and durability may be used. Illustratively, the housing 702 has the following dimensions: width, about 6.5 inches, depth about 5.5 inches, and height about 5.5 inches. Illustratively, the square diaphragm plates 750 are each about 3.92 inches by about 3.92 inches.

As shown in FIGS. 25 and 27, the air pulse generator 700 further includes first and second generally elliptical cams 732, 742 mounted on a common shaft 770 for rotation therewith. A motor (not shown) is coupled to the shaft 770 and is operable to rotate the shaft 770. The first cam 732 is rotatable to move the first pair of opposed diaphragms 730, toward and away from each other, as shown by the arrows 738, along a first axis 734. The second cam 742 is rotatable to move the second pair of opposed diaphragms 740, toward and away from each other, as shown by the arrows 748, along a second axis 744 that is substantially perpendicular to the first axis 734. The first and second generally elliptical cams 732, 742 are mounted on the shaft 770 such that when the first pair of diaphragms 730 move toward each other, the second pair of diaphragms 740 move toward each other and such that when the first pair of diaphragms 730 move away from each other, the second pair of diaphragms 740 move away from each other. Thus, at any point in time, all four diaphragms 730, 740 are either moving inwardly toward the center of the housing 702 or moving outwardly away from the center of the housing 702. This causes the pressurized air in the chamber 754 to pulse by repetitively increasing and decreasing the air pressure about a baseline pressure. It should be appreciated that the air pressure inside the air chamber 754 and the inflatable garment 442 will typically remain above atmospheric pressure throughout the cycle.

As shown in FIGS. 25 and 27, the air pulse generator 700 includes a first pair of springs 736, arranged to bias the diaphragm plates 750 of the first pair of diaphragms 730 toward each other. The springs 736 are held in a state of compression between the diaphragm plates 750 of the first pair of diaphragms 730, and the associated walls 704, 706 of the housing 702. The air pulse generator 700 includes a second pair of springs 746, arranged to bias the diaphragm plates 750 of the second pair of diaphragms 740, toward each other. The springs 746, are held in a state of compression between the diaphragm plates 750 of the second pair of diaphragms 740, and the associated walls 708, 710 of the housing 702. The bias of springs 736, 746 helps keeps the ends of piston rods 751 in contact with cams 732, 742. In alternative embodiments, the air pulse generator 700 may include Scotch yoke assemblies (e.g., circular cams having centers offset from the motor shaft and having surrounding cam frames which each receive a respective circular cam therein and which each are shifted back and forth in a cyclical manner due to rotation of the motor shaft and eccentrically mounted circular cams) to move the first pair of diaphragms 630 in the opposite directions and to move the second pair of diaphragms 640 in the opposite directions. An example of such Scotch yoke assemblies may be seen in U.S. Pat. No. 6,254,556.

Figure 28:
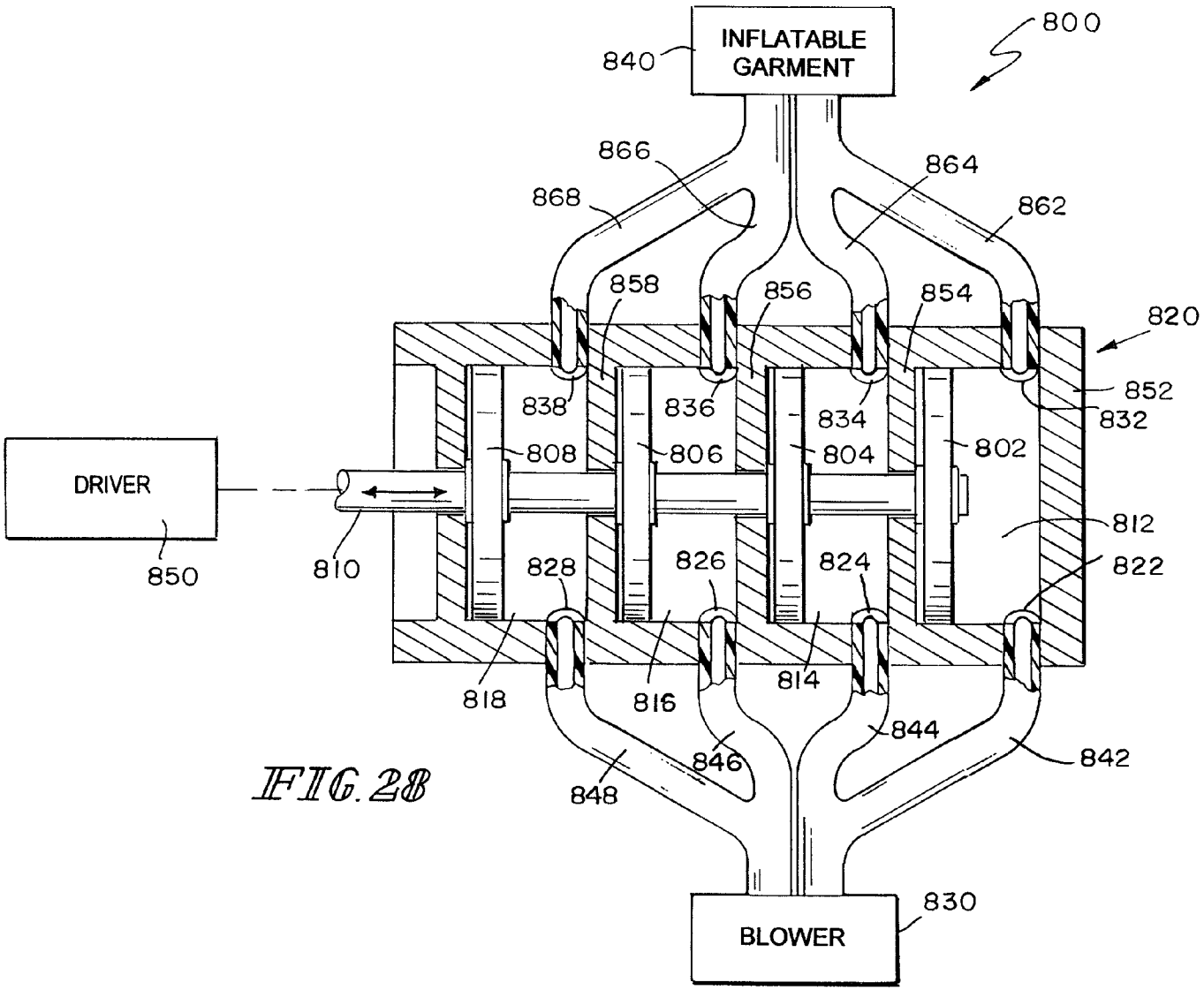
FIG. 28 is a diagrammatic view of an eighth embodiment of the air pulse generator of FIG. 1 showing multiple pistons that move in unison with a piston rod and showing a cylinder in which the pistons are situated in multiple chambers, each having a first port coupled to a blower and a second port coupled to an inflatable garment.

FIG. 28 is a diagrammatic view of the eighth embodiment 800 of the air pulse generator 32 of FIG. 1. As shown therein, the air pulse generator 800 includes a plurality of pistons 802, 804, 806, 808 mounted on a piston rod 810 for movement therewith. The air pulse generator 800 further includes a cylinder 820 having a plurality of air chambers 812, 814, 816, 818 in which the associated pistons 802, 804, 806, 808 are situated. Each chamber 812, 814, 816, 818 has an inlet port 822, 824, 826, 828 coupled to a blower 830 and an outlet port 832, 834, 836, 838 coupled to an inflatable garment 840. A driver 850, coupled to the piston rod 810, causes the pistons 802, 804, 806, 808 to reciprocate in respective chambers 812, 814, 816, 818. As the piston rod 810 moves rearward, the pressurized air from the blower 830 is drawn into the chambers 812, 814, 816, 818 through the associated ports 822, 824, 826, 828 coupled to the respective lines 842, 844, 846, 848. As the piston rod 810 moves forward, the air is compressed in the chambers 812, 814, 816, 818 between the respective pistons 802, 804, 806, 808 and the associated walls 852, 854, 856, 858 of the cylinder 820 to force pressurized air into the inflatable garment 840 through the respective ports 832, 834, 836, 838 coupled to the lines 862, 864, 866, 868. In some embodiments, check valves (not shown), coupled to the inlet ports 822, 824, 826, 828, allow the pressurized air from the blower 830 to flow into the air chambers 812, 814, 816, 818 through the associated ports 822, 824, 826, 828 to establish a baseline pressure in the respective chambers 812, 814, 816, 818 and in the inflatable garment 840. In other embodiments, check valves are omitted. However, the check valves automatically close when the compressed air from the air chambers 812, 814, 816, 818 attempts to flow back toward the blower 830 in a reverse direction, for example, when the pressure in the air chambers 812, 814, 816, 818 increases in response to the pistons 802, 804, 806, 808 moving toward the associated walls 852, 854, 856, 858. Thus, the driver 850 is operable to move the pistons 802, 804, 806, 808 in an oscillatory manner relative to the respective chambers 812, 814, 816, 818. This causes the pressurized air in the chambers 812, 814, 816, 818 to pulse by repetitively increasing and decreasing the air pressure about the baseline pressure.

Although certain illustrative embodiments have been described in detail above, variations and modifications exist within the scope and spirit of this disclosure as described and as defined in the following claims.

The invention claimed is:

1. An air pulse generator for providing a high frequency chest wall oscillation therapy to a patient, the air pulse generator comprising:

a housing, and an air pulse assembly coupled to the housing, the air pulse assembly having a first diaphragm and a second diaphragm, a first driver operable to move the first diaphragm, a second driver operable to move the second diaphragm, wherein the first and second drivers are operated to move the first and second diaphragms reciprocally in opposite directions toward and away from each other to produce oscillatory pressure pulses, a first coil spring arranged to bias the first diaphragm away from a first portion of the housing and toward the second diaphragm, and a second coil spring arranged to bias the second diaphragm away from a second portion of the housing and toward the first diaphragm, the first and second coil springs being elements that are separate and distinct from the first and second diaphragms, the first and second diaphragms each comprising a resiliently flexible seal having an outer periphery secured to the housing and forming a substantially fluid tight seal therewith.

2. The air pulse generator of claim 1, wherein the first and second springs are positioned in a state of compression between the respective first and second diaphragms and the respective first and second portions of the housing.

3. The air pulse generator of claim 1, wherein the first and second drivers each comprise a current-carrying coil and a permanent magnet.

4. The air pulse generator of claim 3, wherein the current-carrying coils are coupled to the respective diaphragms and the permanent magnets are coupled to the respective first and second portions of the housing.

5. The air pulse generator of claim 4, wherein the first and second coil springs each have a bore and the permanent magnets each comprise a ring-shaped body located in the bore of the respective first and second coil springs.

6. The air pulse generator of claim 1, wherein the first and second drivers each comprise an oscillating current-carrying coil coupled to one of the respective first and second diaphragms and the respective first and second portions of the housing and a DC current-carrying coil coupled to the other of the respective first and second diaphragms and the respective first and second portions of the housing.

7. The air pulse generator of claim 6, wherein the DC current-carrying coils each have a first ring-shaped body defining an a first interior space and the oscillating current-carrying coils are located in the first interior spaces of the respective first ring-shaped bodies.

8. The air pulse generator of claim 7, wherein the oscillating current-carrying coils each have a second ring-shaped body defining a second interior space and the first and second springs are located in the second interior spaces of the respective second ring-shaped bodies.

9. The air pulse generator of claim 1, wherein the first and second portions of the housing comprise first and second walls, respectively, and the first and second diaphragms are situated between the first and second walls.

10. The air pulse generator of claim 1, wherein the first and second portions of the housing comprise first and second walls, respectively, the first driver comprises a first oscillating current-carrying coil coupled to the first diaphragm and a first DC current-carrying coil coupled to the first wall, and the second driver comprises a second oscillating current-carrying coil coupled to the second diaphragm and a second DC current-carrying coil coupled to the second wall.

11. The air pulse generator of claim 10, further comprising an air chamber located between the first and second diaphragms, wherein the housing has an air port in communication with the air chamber and the housing has a blower inlet spaced from the air port and in communication with the air chamber.

12. The air pulse generator of claim 11, further comprising an inflatable garment arranged to be positioned over the patient and a blower to supply air under pressure, wherein the air port is connectible to the inflatable garment and the blower inlet is connectible to the blower.

13. The air pulse generator of claim 12, further comprising a check valve coupled to the blower inlet.

14. The air pulse generator of claim 12, wherein a portion of the air from the blower is diverted to cool the DC current-carrying coil.

* * * * *